US009108796B2

(12) United States Patent
Cudworth

(10) Patent No.: US 9,108,796 B2
(45) Date of Patent: Aug. 18, 2015

(54) WASTE STORAGE DEVICE

(75) Inventor: Nicholas Cudworth, Pittington (GB)

(73) Assignee: Sangenic International Limited, Cramlington (GB)

( * ) Notice: Subject to any disclaimer, the term of this patent is extended or adjusted under 35 U.S.C. 154(b) by 669 days.

(21) Appl. No.: 12/993,228

(22) PCT Filed: May 15, 2009

(86) PCT No.: PCT/GB2009/001219

§ 371 (c)(1),
(2), (4) Date: Jan. 21, 2011

(87) PCT Pub. No.: WO2009/141583

PCT Pub. Date: Nov. 26, 2009

(65) Prior Publication Data

US 2011/0099954 A1 May 5, 2011

(30) Foreign Application Priority Data

May 19, 2008 (GB) ..... 0809074.8
Nov. 7, 2008 (GB) ..... 0820493.5

(51) Int. Cl.
*B65B 67/12* (2006.01)
*B65F 1/06* (2006.01)
*B65B 9/13* (2006.01)

(52) U.S. Cl.
CPC . *B65F 1/062* (2013.01); *B65B 9/13* (2013.01); *B65B 67/1277* (2013.01); *B65F 2210/1675* (2013.01); *B65F 2240/132* (2013.01)

(58) Field of Classification Search
USPC ..... 53/567, 576, 370, 138.8, 459
See application file for complete search history.

(56) References Cited

U.S. PATENT DOCUMENTS

| | | | | |
|---|---|---|---|---|
| 6,974,029 | B2 * | 12/2005 | Morand et al. | 206/303 |
| 7,114,314 | B2 * | 10/2006 | Stravitz | 53/567 |
| 7,743,588 | B2 * | 6/2010 | Webb et al. | 53/567 |
| 2003/0121923 | A1 * | 7/2003 | Morand et al. | 220/495.07 |
| 2004/0020175 | A1 * | 2/2004 | Stravitz | 53/567 |
| 2005/0016890 | A1 * | 1/2005 | Tannock | 206/497 |

(Continued)

FOREIGN PATENT DOCUMENTS

| | | |
|---|---|---|
| GB | 2206094 A | 12/1988 |
| GB | 2292725 A | 3/1996 |
| JP | 07-028104 | 5/1995 |

(Continued)

OTHER PUBLICATIONS

Sangenic International Limited, International Search Report mailed Sep. 8, 2009 from the European Patent Office acting as International Searching Authority in PCT/GB2009/001219.

*Primary Examiner* — Sameh Tawfik
(74) *Attorney, Agent, or Firm* — Nixon Peabody LLP

(57) ABSTRACT

A waste storage device includes a waste storage cassette receiving chamber for receiving a cassette rotatable within the chamber and containing tubing for enveloping waste. The chamber includes a rotatable portion (602) mounted on a fixed portion (604) of the device, the rotatable portion (602) being rotatable with the cassette. The device further comprises a deformable portion (601) mounted on the fixed portion (604) and moveable between an undeformed position to prevent rotation of the cassette and a deformed position to allow rotation of the cassette.

14 Claims, 22 Drawing Sheets

(56) References Cited

U.S. PATENT DOCUMENTS

| | | | | |
|---|---|---|---|---|
| 2005/0028491 | A1 | 2/2005 | Stravitz | |
| 2005/0106706 | A1 | 5/2005 | Chomik et al. | |
| 2006/0237461 | A1* | 10/2006 | Chomik et al. | 220/495.06 |
| 2008/0272140 | A1* | 11/2008 | Mowers et al. | 221/69 |

FOREIGN PATENT DOCUMENTS

| | | | |
|---|---|---|---|
| JP | 2007-510600 | | 4/2007 |
| WO | 9939995 | A1 | 8/1999 |
| WO | 2005042381 | A2 | 5/2005 |

* cited by examiner

WASTE STORAGE DEVICE

CROSS-REFERENCE TO RELATED APPLICATIONS

This Application is a United States National Stage Application under 35 U.S.C. §371(c) from PCT/US2009/001219 filed May 15, 2009, currently pending, which claims priority to Great Britain Application No. 0809074.8 filed May 19, 2008 and Great Britain Application No. 0820493.5 filed Nov. 7, 2008, the disclosures of which are incorporated by reference as if fully set forth herein.

FIELD OF THE INVENTION

The invention relates to a waste storage device and cassette.

BACKGROUND OF THE INVENTION

One known waste storage device is disclosed in GB Patent No. 2206094 and described here with reference to FIG. 1. The device is particularly useful for the storage for subsequent disposal of waste such as babies' nappies or other personal waste material. A plastics container 21 is formed with an internal flange 22 from which a cylinder 23 extends upwards. A pack consisting of a tubular core 1 inside a profusely circumferentially pleated length of flexible tubing 2 is located in the container 21 with the core 1 resting on the flange 22 and rotatable on the cylinder 23. To begin using the pack to form a series of packages of objects, which in this particular example will be considered to be babies' disposable nappies, the top of the flexible tubing 2 is pulled upwards and tied into a knot 24. This closed end can then form the bottom of a package to be formed along the length of part of the tubing. This is effected by pushing the closed end downwards inside the core 1 and cylinder 23 by the object to be packaged. As this is being done the flexible tubing 2 from the pleated length slides over the top edge 25 (FIG. 1) of the core 1 which is made sufficiently smooth to prevent the flexible tubing from being damaged. The core 1 may be approximately four inches (10.16 cm) diameter but, of course, the diameter of the flexible tubing 2 is substantially more than this.

When the object has been thrust well into the concentric core 1 and cylinder 23, the package is closed by twisting the flexible tubing 2 above the object as at 30 (FIG. 1). This is done by turning the core 1 with remaining pleated tubing thereon about the core axis. A unit 31 is formed for this purpose in that it has a depending annular flange 50 formed with an outer surface that is a taper fit in a frusto-conical inner surface 51 at the top of the core 1. The package is prevented from turning about the axis of the core during this manual twisting action by springs 52 fixed to the container 21 and projecting radially inwards to engage the package. These springs are equidistantly spaced round the container 21. Shallow grooves dividing upwardly extending ridges are formed on the frusto-conical inner surface 51 to stop slippage of the flexible tubing during the twisting operating.

By the aforesaid means, a series of connected closed packages 35 are formed and this can be continued until the pleated tubing 2 is exhausted. In the arrangement of FIG. 1 the packages collect in a bin portion 36 of the container closed at the bottom by a hinged base 53 normally held closed by a manually operable catch of suitable type. When it is desired to remove the packages from the bin portion 36 for transport to a waste disposal facility, the uppermost package is severed above its upper twisted closure 30 and the hinged base 53 opened for the removal of the packages through the end of the bin portion. Even if the twisted seals between the packages become loosened, the lid and the newly formed topmost twisted seal with prevent the escape of odours, vapours and gases to the ambient atmosphere. However, it has been found that when the tubing 2 is made of high density polyethylene the twisted joints remain remarkably tight.

A development of this arrangement is disclosed in GB 2292725 and described here with reference to FIG. 2. It will be seen that an outwardly flared funnel 12 having an inlet edge 15 is detachably connected to the top of the core 1 by a taper joint 16. The funnel improves the hygiene of the device yet further because the flexible tubing 2 is drawn from the pack as an object is pushed down, over the inlet edge 15 of the funnel 12 to present a fresh and hygienic layer of tubing in the flared part of the funnel. The funnel 12 is twisted to obtain the twisted closure 30. An alternative spring arrangement 14 is shown in FIG. 2 and described fully in GB 2292725.

GB 2206094 and GB2292725 both additionally disclose a cutting arrangement for severing the tubing when it is desired to remove the packages for disposal. Referring to FIG. 3, the severing means is incorporated in the unit 31 which is a bipartite unit comprising an outer ring 55 formed with a flange 50 that locks into the top of the core 1 or funnel 12 and a disc 56 which is freely rotatable in the ring 55. The disc 56 comprises a circular transparent sheet 57, through which the user can see the twisted flexible tubing, set in an angle section ring having a horizontal flange 58 and a vertical flange 59 (FIG. 1) located between narrow flanges inside the relatively stationary flange 50. In the angle of the ring 58, 59 three finger pieces 60 are fixed 120° apart above the transparent sheet 57. A cutter unit 61 is fixed beneath the flange 58. This device has an upper actuate part 62 and a lower tapered shoe 63 with a gap between them along the major portion of their length. Close to the closed termination of this gap a metal cutter blade 64 is fixed as close as possible to the relatively stationary flange 50 so that the blade is shrouded against doing any damage to a person's fingers when the lid 31 is removed. The predominant material for the lid may be plastics material or metal.

To operate the cutter unit 61, the disc 56 is turned by means of the finger pieces 60 or any other suitable finger pieces through a full revolution. In this movement the tapered shoe 63 pierces through the radially pleated taut portion 65 of the flexible tubing that flares outwards from the topmost twist 30 to the core 1. Further rotation of the disc 56 causes the cutter blade 64 to cut round the tubing material, cleanly separately the uppermost package from the flexible tubing remaining on the core 1. The cutter unit further includes a finger releasable detent operable at 120° intervals.

In a further improvement, WO99/39995 describes a cutter of similar type to that described above with reference to FIG. 3 but formed integrally with a hinged lid for a waste storage container. The hinged lid swings down to close the container and as a result the cutter automatically engages the tubing allowing a simplified cutting arrangement.

One further known device which is designed for the storage of nappy waste is described in WO2005/042381 (Sangenic International Limited). According to WO2005/042381 a waste container is provided for housing a waste storage cassette as described above. The container includes gripping means to hold a waste package in place whilst the cassette is rotated with respect to the waste package. This forms a twisted seal in the top of the waste package, wherein the twisted seal also acts as the base of a length of tubing for packaging the next waste item to be disposed of.

BRIEF DESCRIPTION OF THE DRAWINGS

Embodiments of the invention will now be described by way of example with reference to the drawings of which.

DETAILED DESCRIPTION OF THE DRAWINGS

Referring to FIGS. 4 to 10 a waste storage device embodiment can be seen in more detail. The waste storage device 100 includes a waste storage chamber 102 having a removable cover 104. As described in more detail below, the removable cover 104 includes a waste cassette receiving chamber for receiving a waste storage cassette having flexible tubing for enveloping waste items and further includes means for rotating a waste storage cassette with respect to the waste cassette receiving chamber in order to create sealed waste packages in the flexible tubing. The waste storage chamber 102 and removable cover 104 may fit together by any suitable means such as a tab and cooperating recess. The removable cover 104 includes a lid 106. The lid 106 is preferably hingedly attached to the cover 104 such that it can be actuated in order to provide user access to the inside of the cover 104.

Figure 5:
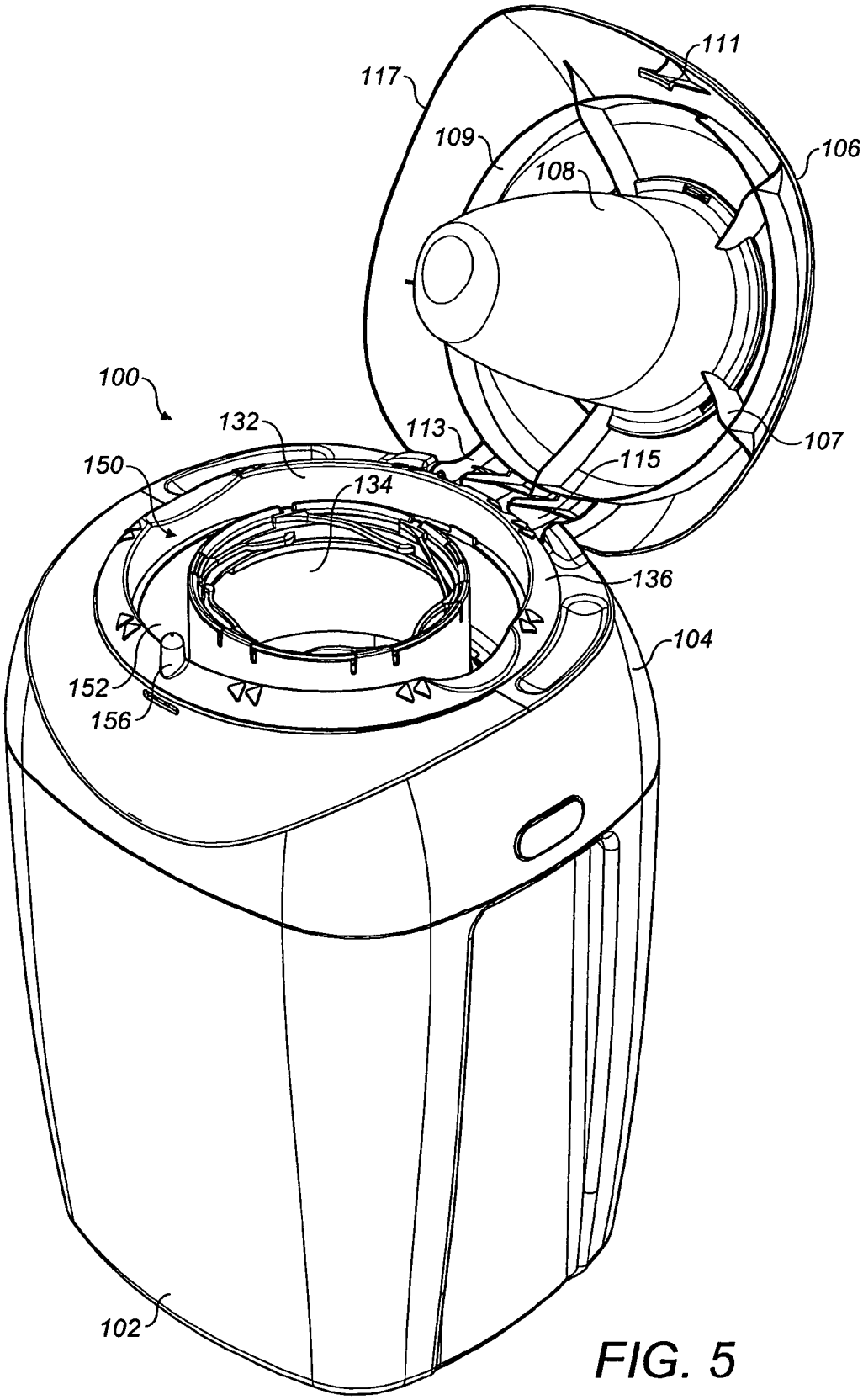
FIG. 5 is a perspective view of the waste storage device of FIG. 4, with the lid in an open configuration.

FIG. 5 shows an embodiment of the waste storage device 100 with the lid 106 in an open position. A plunger 108 extends downwardly from an under surface of the lid 106. The plunger is fixed relative to the lid so that movement of the lid provides movement of the plunger. Preferably the plunger 108 and lid 106 share a common central axis along the extension direction of the plunger 108. The plunger 108 may be hollow, with an open upper end covered by the lid 106 and a closed lower end. According to an embodiment, the plunger 108 is substantially circular in cross section and tapers radially inwards towards its lower end. This tapering provides clearance for insertion of the plunger 108 into a throat or other waste aperture defined within the removable cover 104 when the lid 106 is closed, as described in more detail below. The plunger 108 may be formed integral to the lid 108 or may attach to the lid 106 by any appropriate inter-engagement means such as a screw fit or snap fit. Optionally, the portion of the lid 106 which covers the upper end of the plunger 108 may be removable.

In order to support the plunger 108 and prevent the lid 106 from deforming under its weight, a plurality of support ribs 107 are provided on the under surface of the lid 106. Preferably the support ribs 107 are spaced apart from one another around the circumference of the upper end of the plunger 108 and each rib 107 extends radially outwards therefrom. Optionally, the lid 106 may include an annular flange 109 extending downwardly from the under surface of the lid 106, wherein the annular flange 109 intersects the support ribs 107 towards their distal ends in order to provide additional support.

Figure 6:
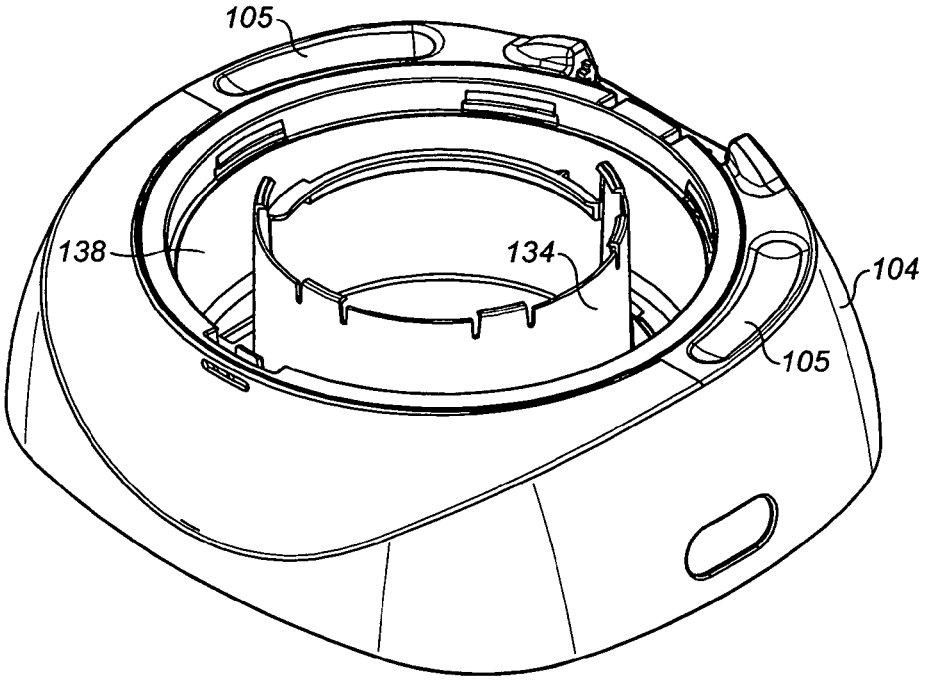
FIG. 6 is a top perspective view of the cover of the waste storage device of FIG. 4.
Figure 7:
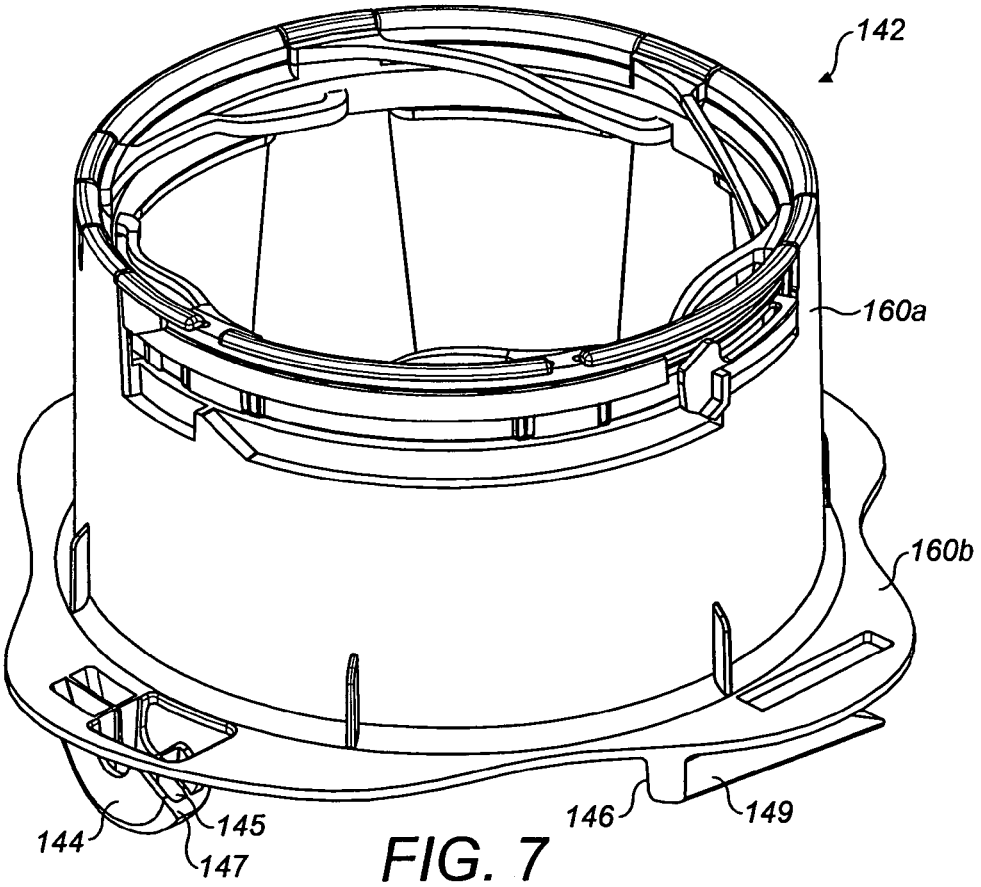
FIG. 7 is a perspective view of an insert for the waste storage cover of FIGS. 4 to 6.

The removable cover 104 can be further understood with respect to FIGS. 6 and 7. Within the cover 104 of the waste storage container there is provided a waste cassette receiving chamber 132 configured for receiving a waste storage cassette. In the embodiment of FIGS. 4 to 10 the waste cassette receiving chamber 132 comprises an annular space defined between cylindrical inner 134 and outer 138 walls, each of which extends below an under surface of the cover 104. The inner wall 134 of the waste cassette receiving chamber 132 defines internally a passage or throat through which waste can be passed into the waste storage chamber 102 as described in more detail below.

Preferably the cover 104 is domed and has walls of sufficient depth that the waste cassette receiving chamber 132 is located at least partially in the space within the cover 104, and does not extend significantly below the walls of the cover 104. This ensures that when the cover 104 is attached to a waste storage chamber 102, the waste cassette receiving chamber 132 and waste cassette 172 do not unnecessarily occupy space in the waste storage chamber 102. Therefore the maximum possible number of waste packages can be effectively stored in the waste storage chamber 102.

On an upper surface of the cover 104, radially outward of the outer wall 138 of the waste cassette receiving chamber 132, there are provided first and second gripping portions 105. The gripping portions comprise of preferably curved indentations in the upper surface of the cover 104, located one either side of the hinged attachment between the lid 106 and the cover. In use, the user can hold one or other gripping portion 105 with one hand whilst rotating a cassette in the waste cassette receiving chamber 132 as described further below. The gripping portions 105 are preferably designed to provide good ergonomic fit for the user's hand and to enable the user the keep the waste storage device 100 steady and stable during manual operation of the device 100.

According to one embodiment, the inner 134 and outer 138 walls of the waste cassette receiving chamber 132 are moulded as a single piece, giving the chamber a U shaped cross section throughout. Alternatively, and as best shown in FIG. 6 only the outer wall 138 of the waste cassette chamber 132 is formed integral to and depends downwardly from the underside of the cover 104 and preferably has an annular flange at its base, wherein the flange 140 extends substantially perpendicularly to and inwardly of the outer wall 138. A separate crown 142 is insertable within the outer wall 138, wherein the crown 142 defines the inner wall 134 of the waste cassette receiving chamber 132 and has a circumference substantially equal to the innermost circumference of the flange 140.

As shown in FIG. 7, the crown 142 includes a cylindrical wall 160*a* forming the inner wall 134 and a base annular flange 160*b* extending outwardly therefrom. The crown 142 can be snapped or otherwise fitted to the outer wall 138 or to the annular flange at the base outer wall 138 of the by means of any appropriate cooperating engagement means for example clips or ridges on the outer surface of the cylindrical wall 160*a* which are insertable into corresponding slots in the cover 104.

Figure 8:
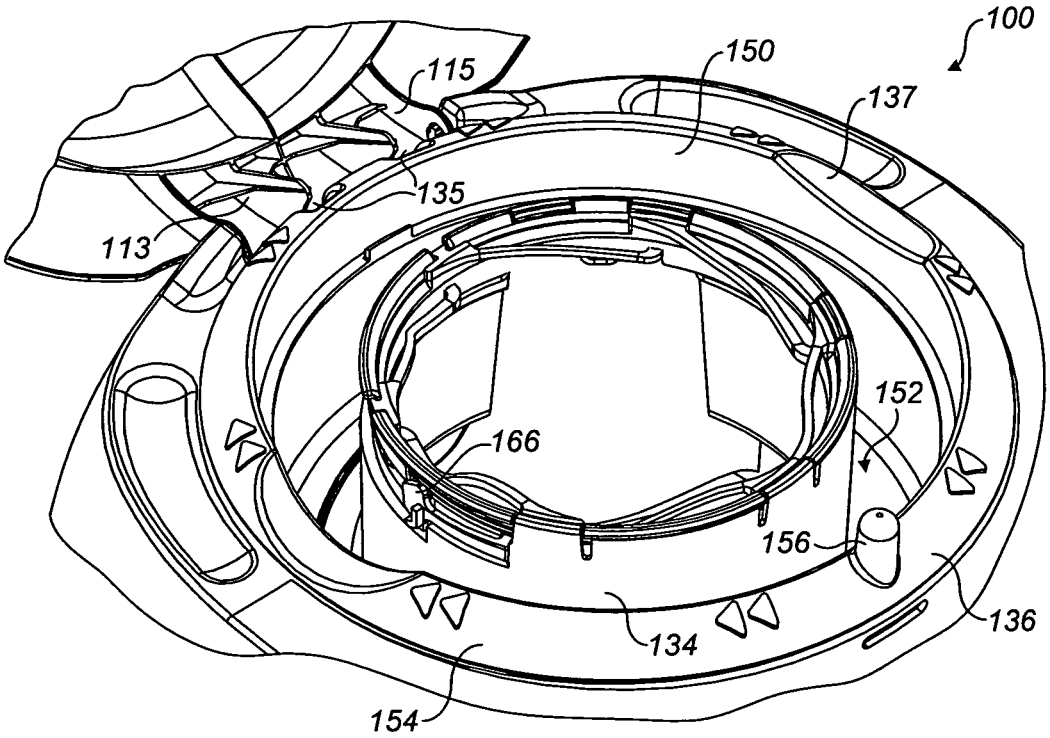
FIG. 8 is a magnified view of the waste cassette receiving chamber of the waste storage device of FIGS. 4 to 7.

Referring to FIGS. 5 and 8, a waste cassette rotator 136 is provided in the waste cassette receiving chamber 132. Preferably the waste cassette rotator 136 comprises a cylindrical wall 150 which extends substantially concentric with the walls of the cassette receiving chamber 132, a rim or annular base 152 extending substantially perpendicular to the wall 150 and terminating radially outward of the inner wall 134 of the waste cassette receiving chamber 132, and an annular rim 154 which extends radially outwards from the top of the wall 150 so that it rests on an upper surface of the cover 104. As shown, the annular rim 154 includes two recesses 135 in its circumference which cooperate with the engagement ribs 113 on the under surface of the lid 106. In particular the recesses 135 are arranged to house the engagement ribs 113 so that, in use, in order for the lid 106 to fully close and lock to the cover 104, the waste cassette rotator 136 must be aligned for insertion of the engagement ribs 113 into the recesses 135. This alignment provides a starting position for user actuation of the waste cassette rotator 136 when the waste storage device 100 is next used.

According to a preferred embodiment the waste cassette rotator 136 further includes a handle 156 on its annular rim 154 which can be actuated by a user in order to rotate the waste cassette rotator 136 about its central axis in the waste cassette receiving chamber 132. The waste cassette rotator 136 is arranged for supporting and housing a waste storage cassette 172 as shown in FIG. 9 and for rotating said cassette 172 with respect to the waste cassette receiving chamber 132 as described in more detail below.

The waste cassette rotator 136 further includes two crescent shaped hollows 137 along the inner circumference of the annular rim 154. The hollows 137 are preferably arranged diametrically opposite one another on the waste cassette rotator 136 and, in use, provide a space for a user to manually grip a cassette 172 housed in the rotator 136 for removal of the cassette 172 therefrom.

Figure 9:
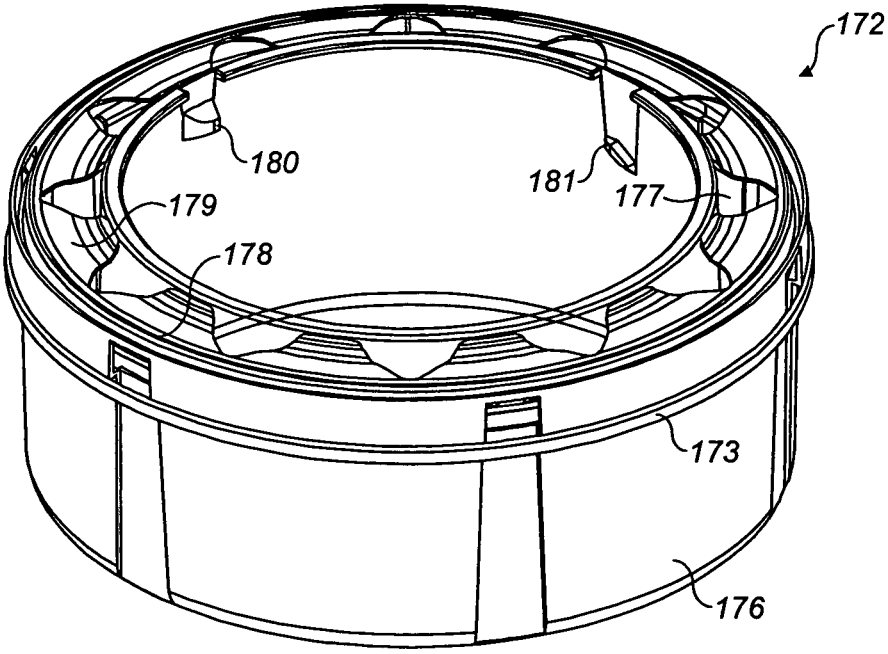
FIG. 9 is a perspective view of a waste storage cassette for the waste storage device of FIGS. 4 to 8.

FIG. 9 shows a waste storage cassette 172 for use within the waste storage device. The waste storage cassette 172 has a housing which comprises annular inner 174 and outer 176 walls, connected at their lower end by a base to form a substantially U shaped cross section throughout. In the cassette housing between the inner 174 and outer 176 walls of the cassette 172 flexible tubing can be housed. Preferably the flexible tubing is layered or pleated within the cassette housing in order to optimise use of the space therein and provide as much tubing in the cassette 172 as possible. Extending radially inward from the upper edge of the outer wall 176 is a flange 178. The flange 178 provides at least a partial cover for the cassette housing, preferably exerting downward pressure on the flexible tubing and keeping it as tightly packed in the housing as possible. There is at least one peripheral gap 177 formed between an outer rim of the flange 178 and the inner wall 174, through which a user can access the flexible tubing in order to pull it over the inner wall 174 as described in more detail below. Preferably, the inner wall 174 has a rounded profile at its upper edges in order to provide minimal friction, hence enabling smooth flow of flexible tubing there over.

According to a preferred embodiment the flange 178 comprises a plurality of inward projections or petals 179 extending from the outer wall 176 towards the inner wall 174 of the cassette 172, with a plurality of gaps 177 therebetween which allow flexible tubing to be dispensed from the cassette housing below. The flange 178 can be clipped, snap-fitted or engaged to the outer wall 176 using any suitable means. Preferably the outer edge of the flange 178 is rounded so as to prevent snagging of the tubing when it passes there over.

Figure 10:
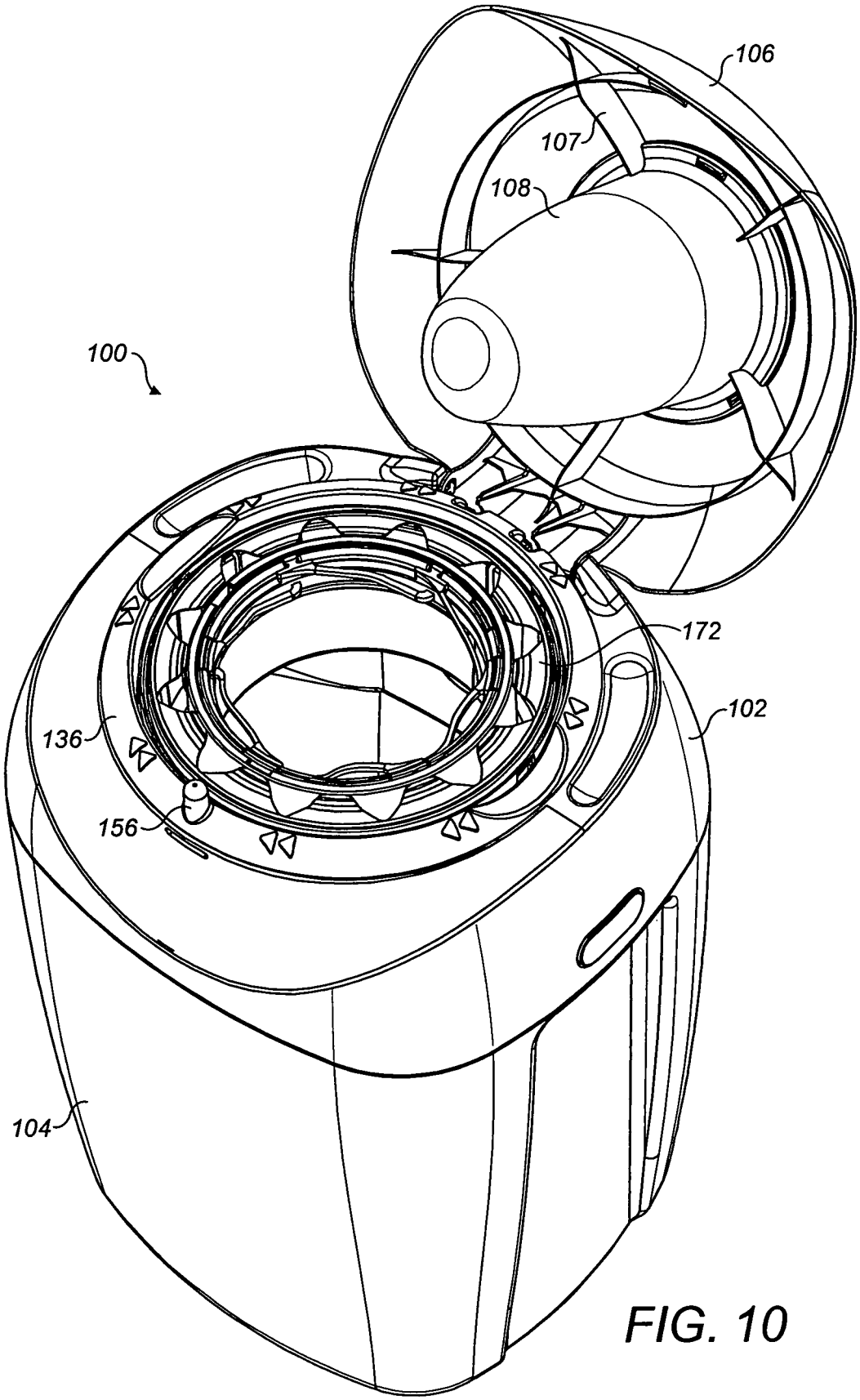
FIG. 10 is a perspective view of the waste storage device of FIGS. 4 to 9 with the lid in an open configuration and with a waste storage cassette housed therein.

Referring to FIG. 10 a waste storage cassette 172 is seen in situ in the waste cassette receiving chamber 132 of a waste storage device 100. The cassette 172 is placed in the waste cassette receiving chamber 132, preferably wherein the cassette 172 hangs via the ledge 173 on its outer surface from the rim or annular base 152 of the waste cassette rotator 136. Alternatively, the cassette 172 can be supported at its base by the rim or annular base 152 of the waste cassette rotator 136.

In order to begin using a cassette 172 in the waste storage device 100, the user accesses flexible tubing housed within the cassette 172, pulls a length of tubing therefrom and ties a knot in the end of the tubing. As a result, a sealed hollow of tubing is formed in the throat of the waste storage device 100, radially inward of the inner wall 174 of the cassette 172. At this point the waste storage device 100 and cassette 172 are ready for insertion of a waste item into the hollow of tubing.

Once a user has placed a waste item in the hollow of tubing, he or she then actuates the handle 156 on the waste cassette rotator 136.

Rotation of the waste cassette rotator 136 causes rotation of the cassette 172 located thereon. According to a preferred embodiment, the waste storage cassette 172 and waste cassette rotator 136 include cooperating inter-engagement means, such as a lug and recess arrangement, to ensure that the waste storage cassette 172 rotates synchronously with the waste cassette rotator 136. The inter-engagement means is preferably provided on a bottom outer surface of the cassette 172 such as on an under surface of the ledge 173. Alternatively, the inter-engagement means can be provided on an outer surface of the inner wall 134 of the cassette 172. Further alternatively, the waste storage cassette 172 can rotate with the waste cassette rotator 136 simply because it is supported and/or housed by the waste cassette rotator 136. In addition a gripping mechanism can be provided on the inner annular wall 134 to partially close and hold the tubing against rotation.

Operation of the Plunger

When the lid 106 is closed, the plunger 108 is arranged to prepare the waste storage device 100 and cassette 172 for their next use. Specifically, because the plunger 108 plunges through the aperture in the throat area defined by the open gripping assembly and inner wall 134 of the waste cassette receiving chamber 132, it pushes the previously-formed waste package(s) through the throat, down towards the waste storage chamber 102 below. At the same time, this causes additional flexible tubing to be dispensed from the waste cassette 172 in a metered manner. As a result, the plunger 108 creates a hollow of flexible tubing above the previously-formed waste packages(s), wherein the base of the hollow is formed by the twisted tubing above the previously-sealed waste item. When the user next opens the lid 106 of the waste storage device 100, a waste item can be placed directly in the hollow which the plunger 108 has created. Therefore the user does not have to take any additional steps to prepare the cassette 172 for storage of subsequent waste items, once the lid 106 has been re-opened, nor does the user need to push the previously-formed package(s) down into the waste storage chamber 102 manually.

The plunger 108 is arranged to present a fresh area of tubing which is just big enough to receive a waste item comprising a waste nappy and allow a twist seal to be formed above the nappy, without using any additional flexible tubing unnecessarily. This ensures that the maximum possible number of waste packages can be formed from the flexible tubing stored within a single waste cassette 172, making the cassette more cost-effective and environmentally friendly.

In an alternative embodiment of a waste storage device shown, for example, from FIGS. 11 to 17, the device includes a rotatable spinner or disk 200 with a handle 202. The disk 200 is mounted for a rotation on an annular rim 204 of a formation on the container 221. The cassette 201 has an annular flange 206 around its outer wall resting on the shoulder 204 such that rotation of the disk 200 rotates the cassette to provide the twist in the tubing 202. In an alternative embodiment (not shown) the annular flange 206 on the cassette rests on a formation in the container itself and the disk 200 includes formations such as lugs engaging co-operating formations such as notches in the cassette. In either event a simpler means of rotating the cassette, and with less resistance to rotation, is provided.

Figure 1:
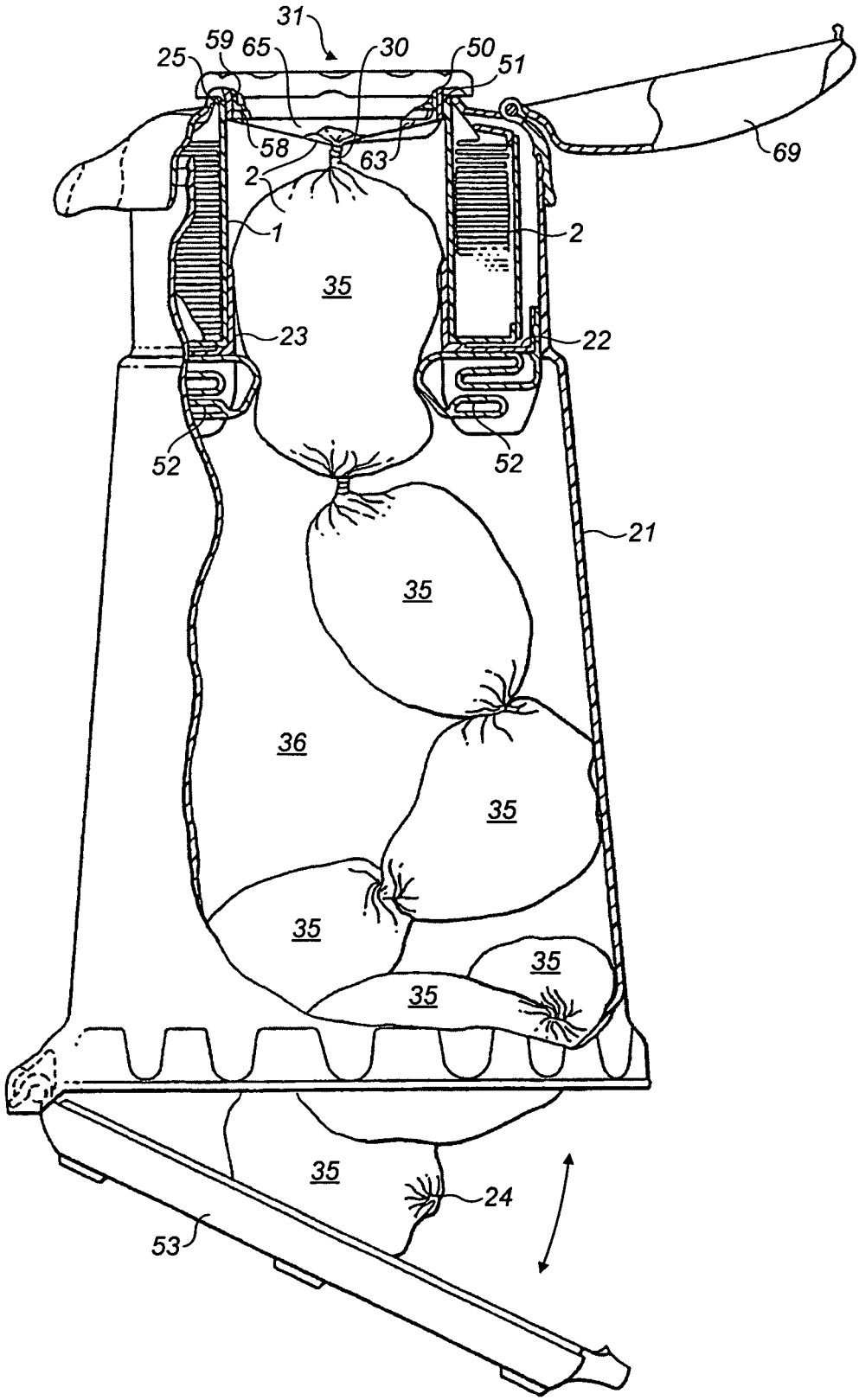
FIG. 1 is a partially cut away side view of a device of known type.
Figure 2:
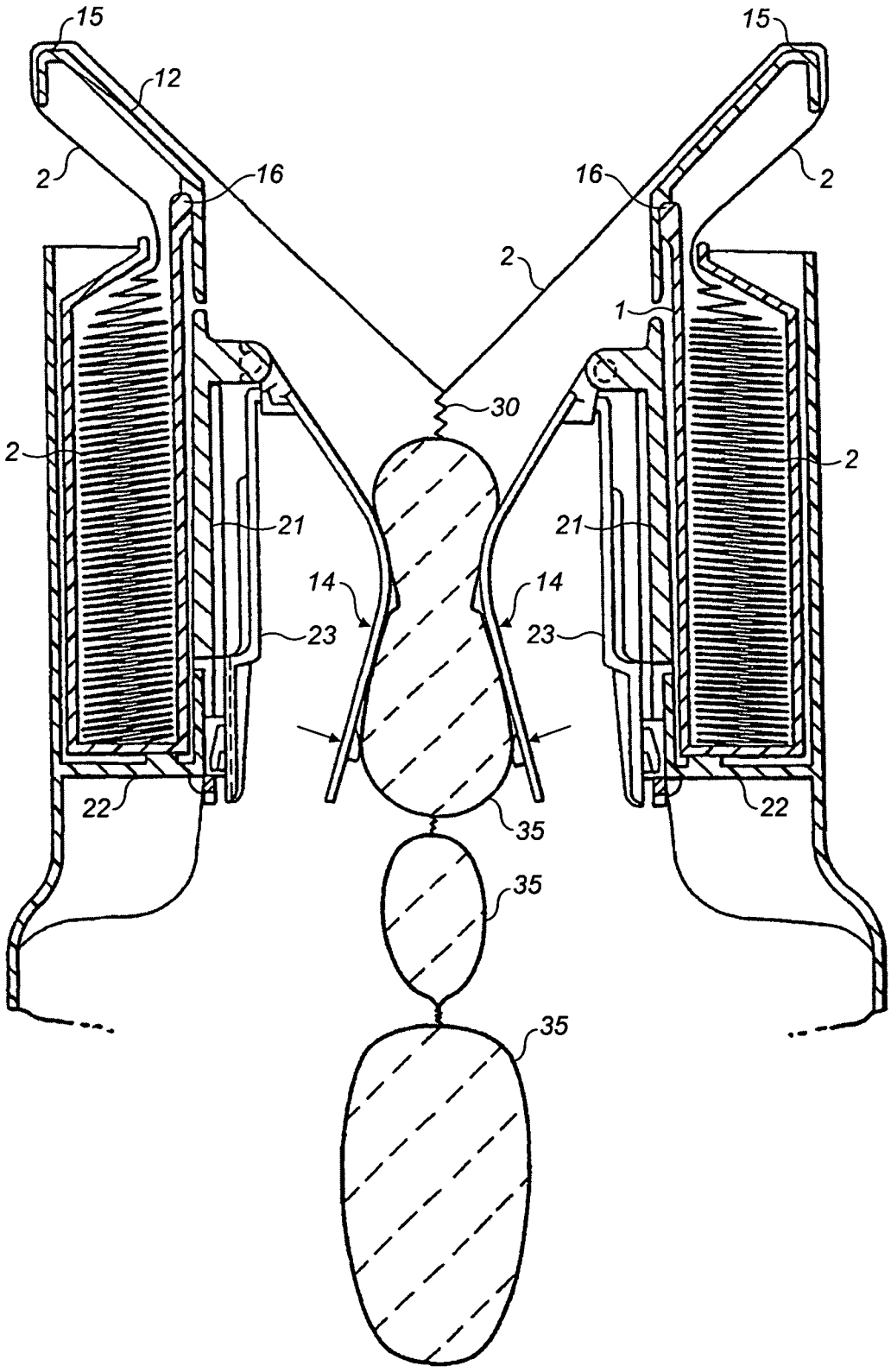
FIG. 2 is a partial sectional side view of another device of known type.
Figure 3:
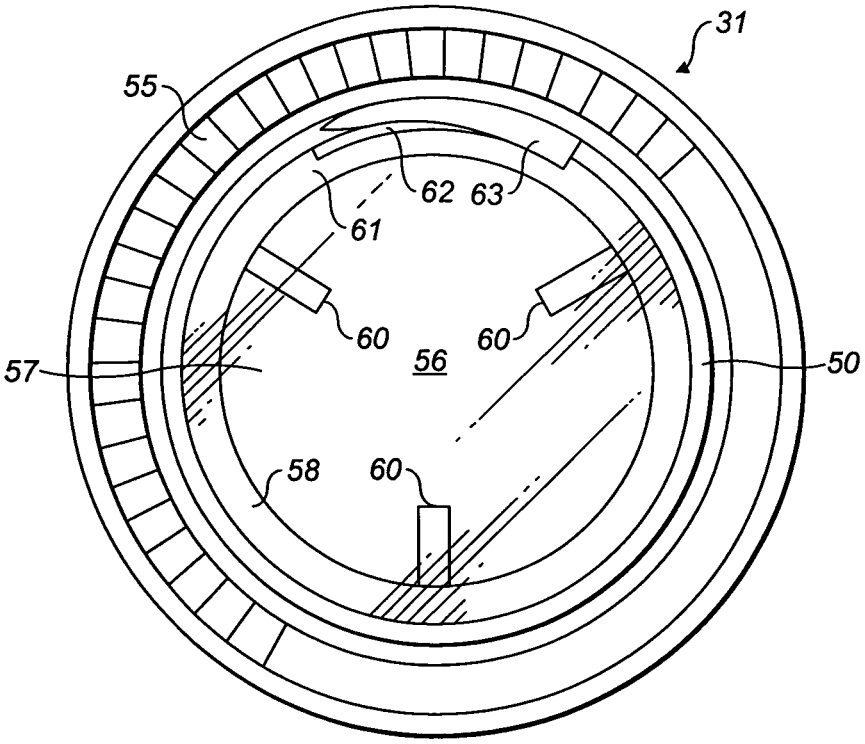
FIG. 3 is an underneath plan view of a cutting device of known type.
Figure 4:
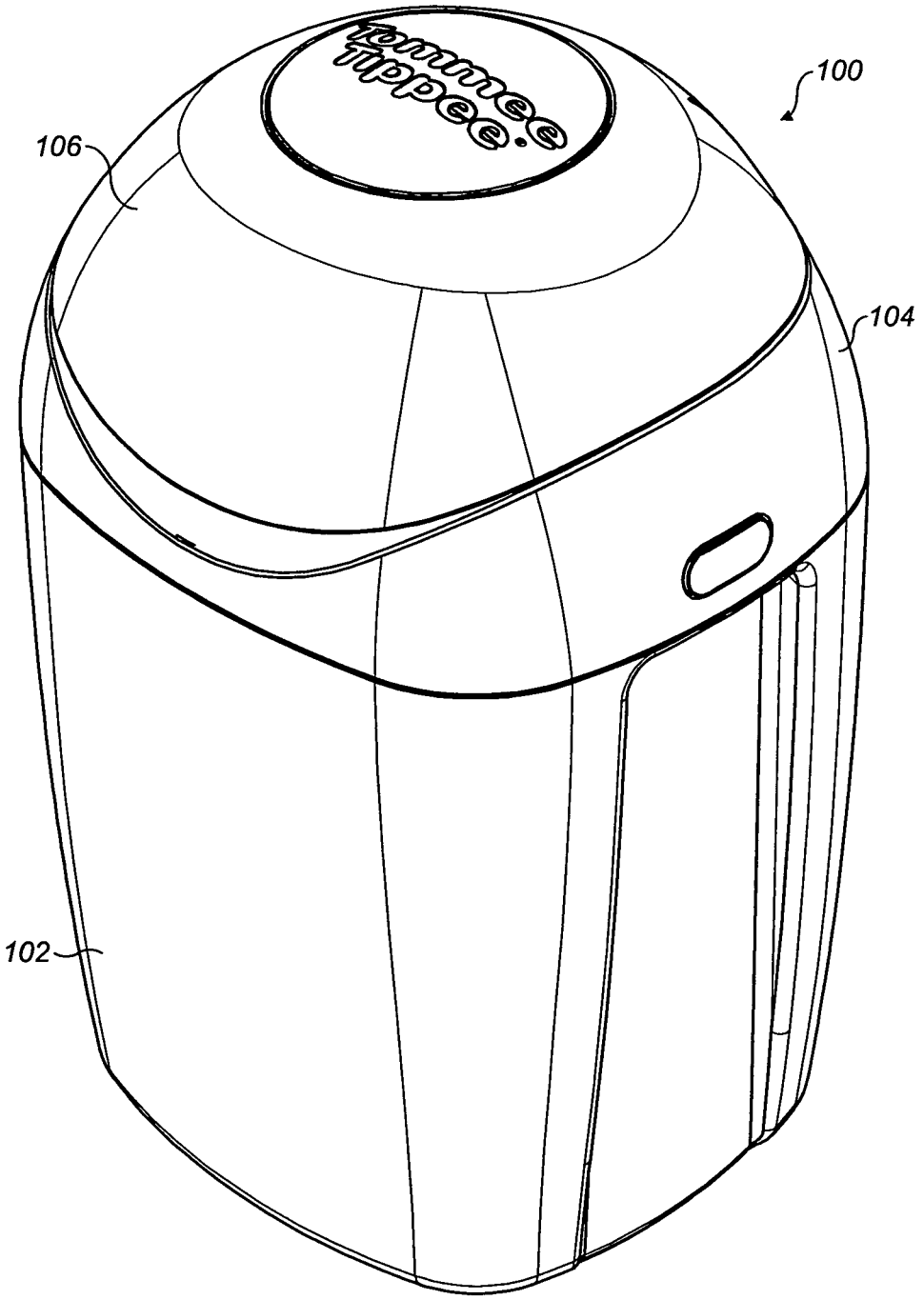
FIG. 4 is a perspective view of an alternative waste storage device.

A hinged lid 270 is further provided on the container 221. The hinged lid 270 includes an integral cutter 257 which engages the tubing 202 against the funnel 212 when the lid 270 is closed to allow cutting of the tubing in the manner discussed above with regard to FIG. 3. The specific configuration of the cutter according to the present invention is described in more detail below.

The container further includes an upper gripping diaphragm 220 and a lower, guide diaphragm 222 mounted on appropriate formations on the container provided in a throat portion of the container 221 below the cassette and formed of flexible material. The upper gripping diaphragm 220 has a central aperture which can be for example circular or circular with lobes as discussed in more detail below and is arranged to hold a package against rotation of the cassette by the rotating disk 200. The lower guide diaphragm 222 has a V-shaped slit as discussed in more detail below ensuring that when a package 235 is pushed through it is directed towards, and engages the side of the container 221 to prevent rotation and untwisting. It will be seen that the diaphragm 222 directs the package 235 towards a side having an additional set-in inner wall or fluted portion 221 a to facilitate contact with the package 235. It will be noted that the hinged lid, rotating disk, cassette and upper and lower diaphragms are all provided on a top portion of the container 221 which can be removed from a lower portion of the container 221 to allow removal of waste stored in the container 221. The two parts can be held together by any appropriate catch means, and optionally the catch also provides an integral handle for moving the container as a whole.

Figure 11:
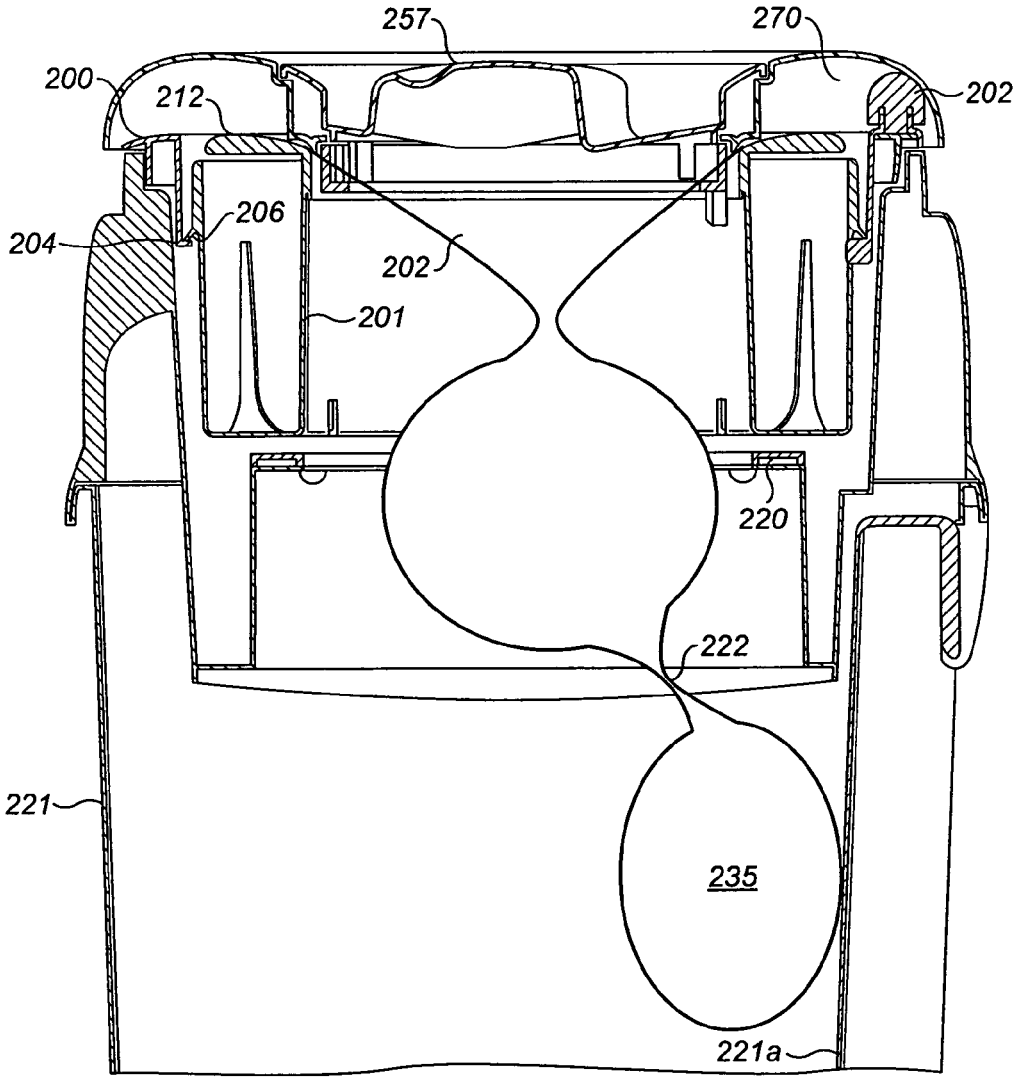
FIG. 11 is a cross section view of an alternative waste storage device.
Figure 12:
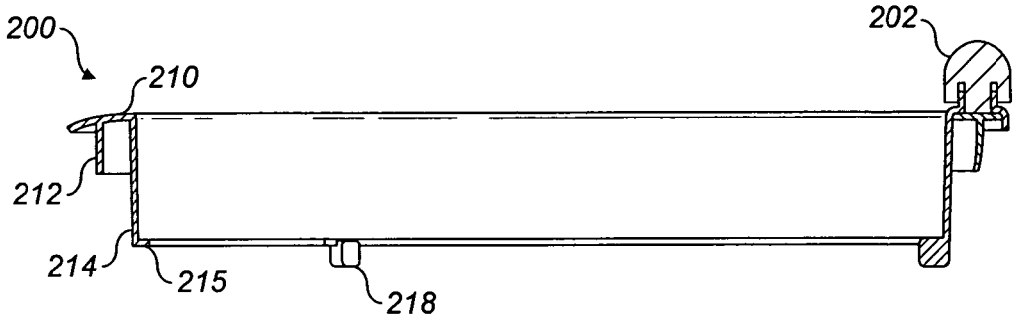
FIG. 12 is cross section view of a rotatable disk for rotating a cassette in the device of FIG. 11.
Figure 13:
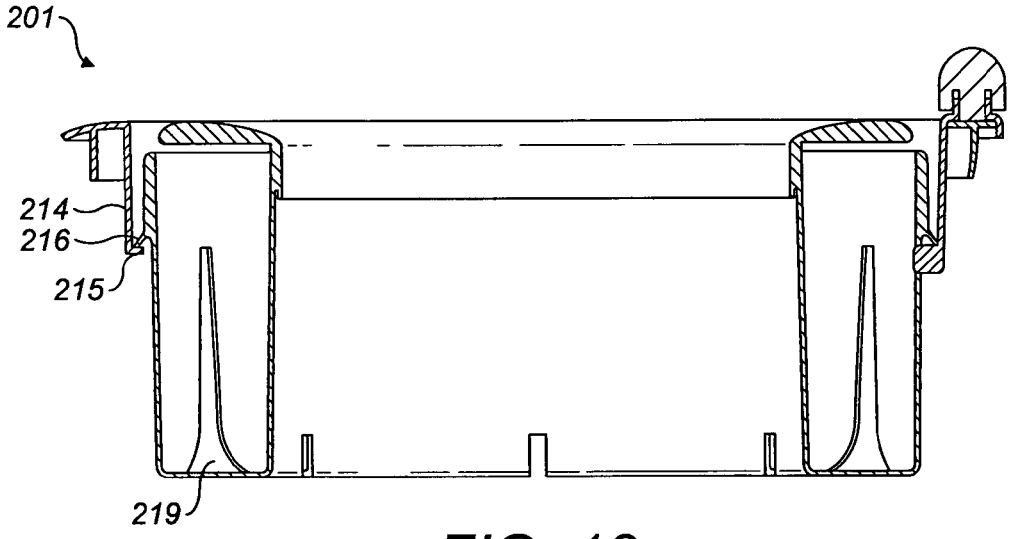
FIG. 13 is a cross section view of the rotatable disk of FIG. 12 carrying a cassette.

The rotatable disk and cassette assembly is described in more detail with reference to FIGS. 12 and 13. The rotatable disk 200 includes an upper annulus 210 carrying a post upon which the handle 202 is mounted to spin freely for ease of rotation of the disk 200 by a user. An outer cylindrical wall 212 depends from the annulus 210, the lower face of which is supported on a support face of the container as can be seen in FIG. 11. An inner cylindrical wall 214 depends from an inner edge of the annulus 210 and has an inwardly projecting annular support flange 215 providing the shoulder 204 at its base supporting, as can be seen from FIG. 13, the cassette 201. The cassette 201 has an outwardly projecting annular flange or lip 216 on its outer wall resting on the support flange 215. In addition a lug 218 projecting from a lower face of the outer cylindrical wall engages in a recess or aperture 219 in the cassette 1 ensuring full rotational engagement. The recess 219 can, for example, also serve as a vent allowing air to escape when tubing is inserted into the cassette during the manufacturing process. Alternatively the cassette can carry a plurality of axially directed ribs around its outer periphery which engage with a co-operating lug or other formation on the rotatable disk 200. The upper annulus 210 can include a cutaway portion allowing the user to access the tubing to pull it out and through the central aperture of the cassette. The tubing may also carry colouring or another indicator at its lower end as an out-of-stock indicator to display to the user when it is nearly depleted.

Figure 14:
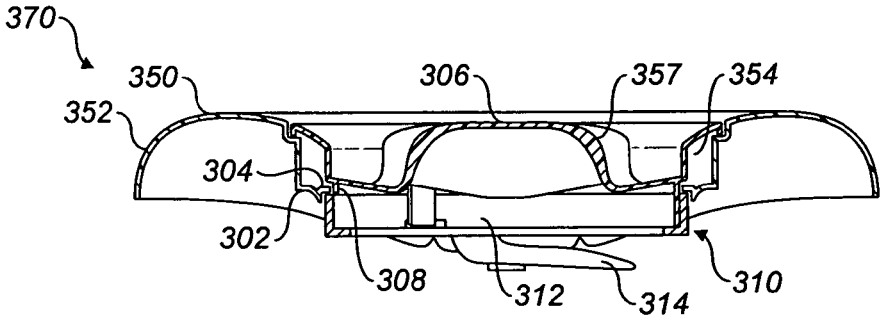
FIG. 14 is a cross section view of a cutter and lid for the device of FIG. 11.

Referring now to FIG. 14 the hinged lid 370 can be seen in more detail as including a disk-shaped rim portion 350 having an external downwardly curved peripheral lip 352 and a downwardly domed inner periphery portion 354 forming a central circular aperture having an inner generally horizontal annular flange 302 with an inner upwardly projecting cylindrical guide lip 304. The cutter 357 includes a handle portion 306 comprising a generally circular body with appropriate grip portions (not shown) mounted rotatably against the hinged lid guide lip 304 and comprising a co-operating inner lip 308 engaging against the guide lip 304 to form a rotation guide. Depending from the handle portion 306 a cutter portion 310 comprises a cylindrical disk 312 with a shoe 314 projecting therefrom carrying a blade (not shown) as discussed in more detail above with reference to FIG. 3. Rotation of the handle portion 306 turns the cutter portion 310 relative to the tubing such that the shoe 314 catches the tubing 2 which rides up to the blade and is cut by continued rotation of the cutter. In an optimisation two blades and respective shoes are provided at 180° intervals around the cutter ensuring that the film is cut all the way around with a single turn of the cutter.

Figure 15:
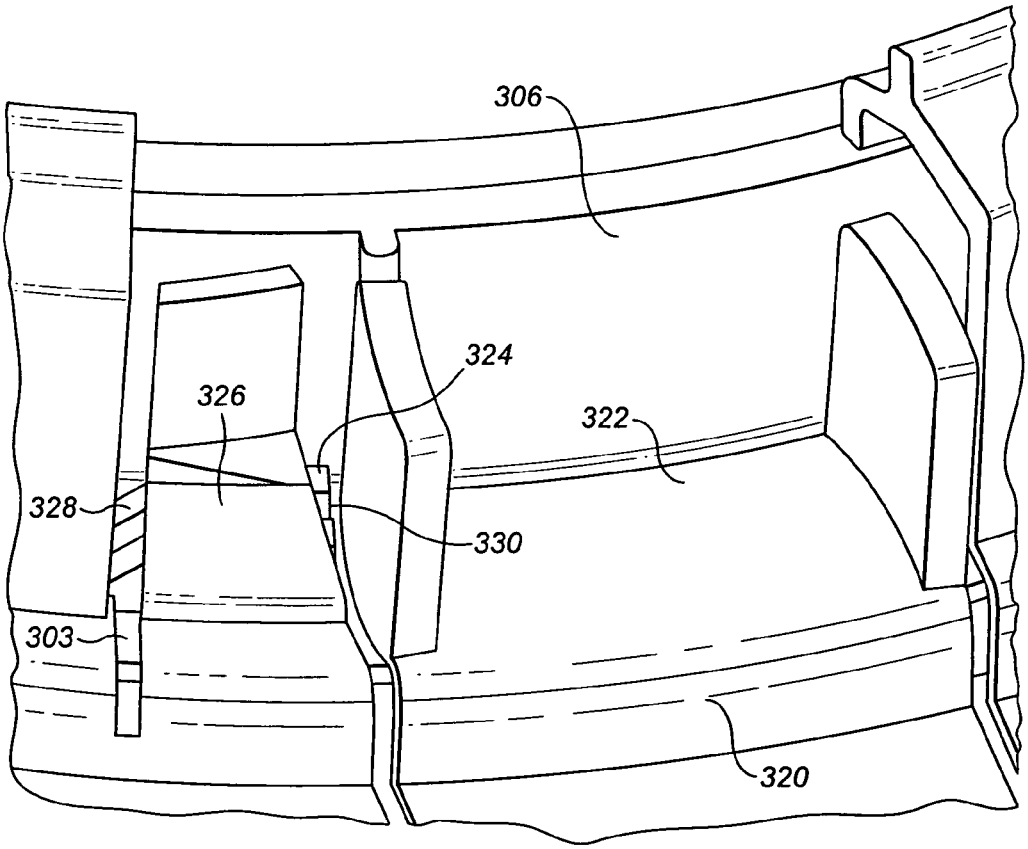
FIG. 15 is a perspective view of a detail of the lid and cutter assembly of FIG. 14.

Referring to FIG. 15 a tamper proof tab 320 provided on the hinged lid 70 can be seen in more detail, viewed from the underside of the lid. The tamper proof tab 320 is resiliently mounted on the lid for example relying on the resilience of the lid material and biased upwardly against downward finger pressure. The tab 320 includes a tongue 322 arranged to engage a corresponding projection 324 on a lower, underside face 303 of the cutter handle portion 306. When the tab is depressed the projection 324 is disengaged allowing rotation of the cutter with the tab released until the projection 324 has rotated around 360° and provides a stop against the tab tongue 322. As a result a single 360° turn is permitted allowing the user to ensure that a full cut has been achieved.

Figure 16:
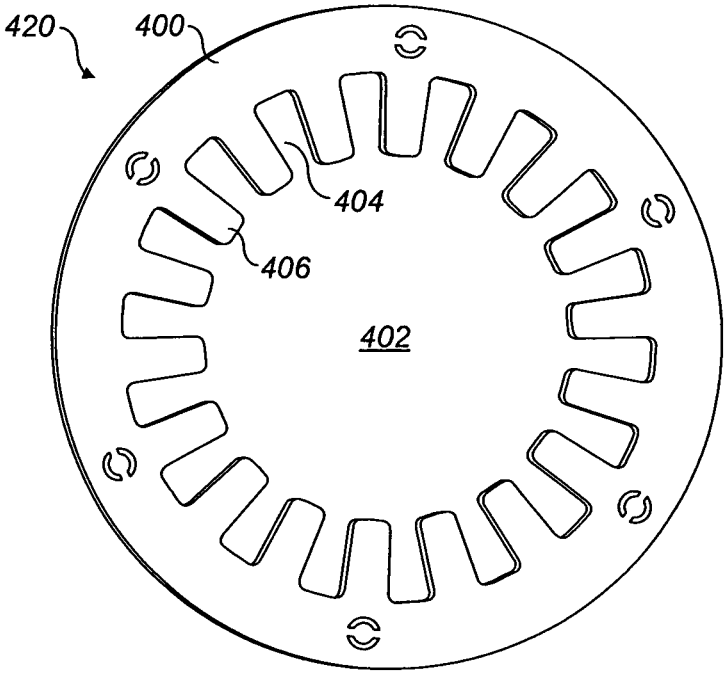
FIG. 16 is a plan view of an upper gripping diaphragm used in the device of FIG. 11.

Referring now to FIG. 16 the upper, gripping diaphragm can be seen in more detail as comprising a main body 400 having a central aperture 402. The central aperture 402 can be circular or of any other appropriate profile and here it can be seen that the circular aperture 402 includes a number of lobes 304 such that the main body 400 has a plurality of projecting fingers 406 projecting into the aperture 402 effectively forming a continuous engagement face but providing additional flexibility. As a result the upper gripping diaphragm 420 provides a clear engagement feel when a package is inserted and held in place so that the user can detect by tactile feedback that the arrangement is ready to twist the tubing above the gripped package. Yet further the effectively continuous engagement face provided by the aperture periphery such as fingers 406 ensures that the tubing is gripped consistently around its circumference such that the cutting operation is performed more efficiently, less loose portions of the tubing being encountered by the cutter.

Figure 17:
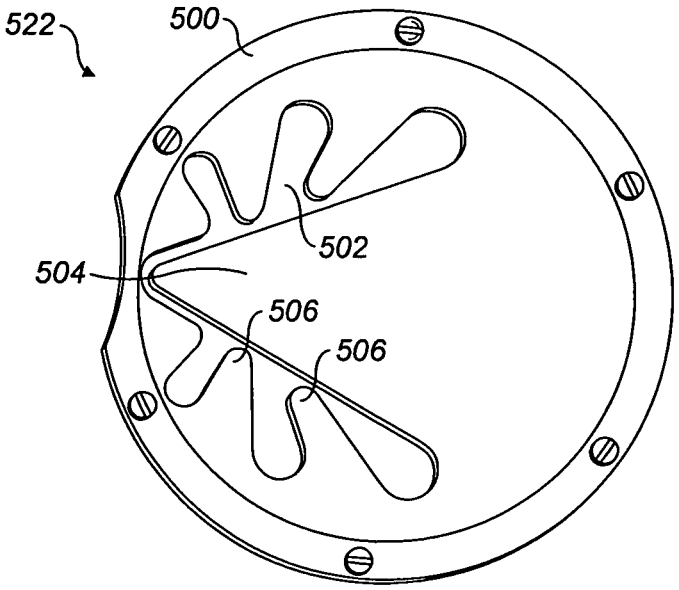
FIG. 17 is a plan view of a lower guide diaphragm of the device of FIG. 11.

Referring now to FIG. 17 the lower, guide diaphragm 522 comprises a main body 500 formed of flexible material and including a V-shaped aperture 502 provided off centre to define a triangular flap 504 whose tip is near the circumference of the main body 500. As a result packages being pressed down through the aperture 502 are generally directed by the flap in the direction of its tip towards the wall of the container beneath it. As a result the package is held against the container wall such that it will not untwist whilst suspended in the container. It will be seen that the aperture 502 defines a plurality of a fingers 506 which improve the flexibility of the arrangement and provide additional guides to the package being pushed through the diaphragm.

Embodiments of the invention will now be described in the context of waste storage devices and cassette of the type described above with reference to FIGS. 1 to 17. It will be appreciated that the embodiments below can be implemented in any waste storage devices as appropriate.

Figure 18A:
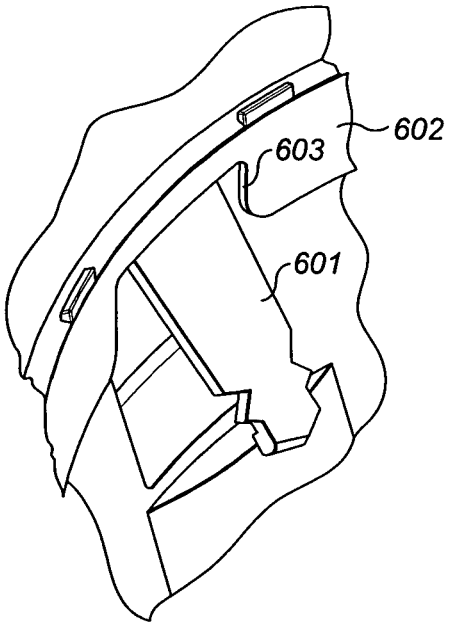
FIG. 18*a* is a partial perspective view of an aspect of the present invention.
Figure 18B:
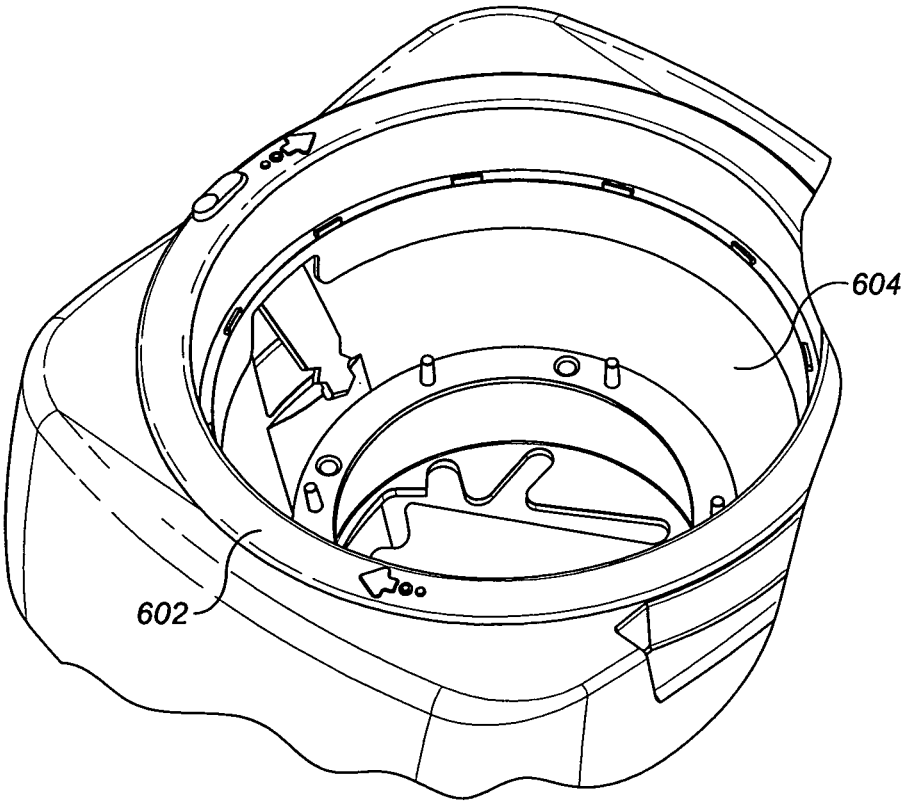
FIG. 18*b* is a larger scale perspective view of the aspect of FIG. 18*a;*

Referring to FIGS. 18*a* and 18*b* a waste storage device includes a rotating portion comprising a rotating ring 602 rotatably mounted on a fixed portion of the housing 604. A waste storage cassette is received in and mounted on the rotating ring 602 and is rotatable therewith in the manner described above. A deformable portion comprising a tab or protruding strip 601 is mounted on the housing 604 and is movable between an undeformed position (as shown) where it prevents rotation of the rotating ring 602, and a deformed position where it permits rotation of the rotating ring and hence cassette.

The deformable portion protrudes through an opening 603 in the rotating ring 602. In particular the protruding strip 601 is angled downwards and inwards into the cavity 604 which receives the film cassette. The protruding strip 601 protrudes through a slot 603 in the rotating ring 602 and is of smaller width than the slot width. The slot is sufficiently high that it allows the protruding strip to protrude into the chamber 604 in an undeformed position. When the protruding strip 601 extends through the slot 603 the rotating ring 602 is prevented from rotating. This is advantageous as, to ensure user friendly operation and reliability, it is preferable to ensure that the film cassette is fitted to the rotating ring with the rotating ring in a predetermined starting position for example where a gripping arrangement is additionally provided and actuated by rotation of the cassette and rotating ring. Because the protruding strip, in its undeformed position, can locate the ring and prevent rotation, the user can install the cassette into the rotating ring in the same starting position each time without the risk of rotation of the ring which in turn ensure that optimum actuation of the arrangement and, for example, any associated gripping device, is not impeded or impaired.

When the cassette is installed, the outer wall of the cassette pushes the protruding strip 601 outwardly and deforms it to a position where it no longer protrudes through the slot 603. As a result the rotating ring and the cassette can rotate freely. In an arrangement, for example, where the cassette includes actuating features arranged to cooperate with other features such as a gripping arrangement, this ensures that exact positioning of the cassette is possible without inadvertent rotation of the ring such that actuating features always start at the same circumferential position.

According to another aspect of the invention the waste storage device receiving chamber 612 includes a base surface 613 having a guide formation 611 in the form of a pin or rib arranged to cooperate with the cassette, for example the outer periphery of the lower end of the outer wall of the cassette or a guide formation such as a guide channel on the cassette base to guide the cassette on a rotating path.

Figure 19A:
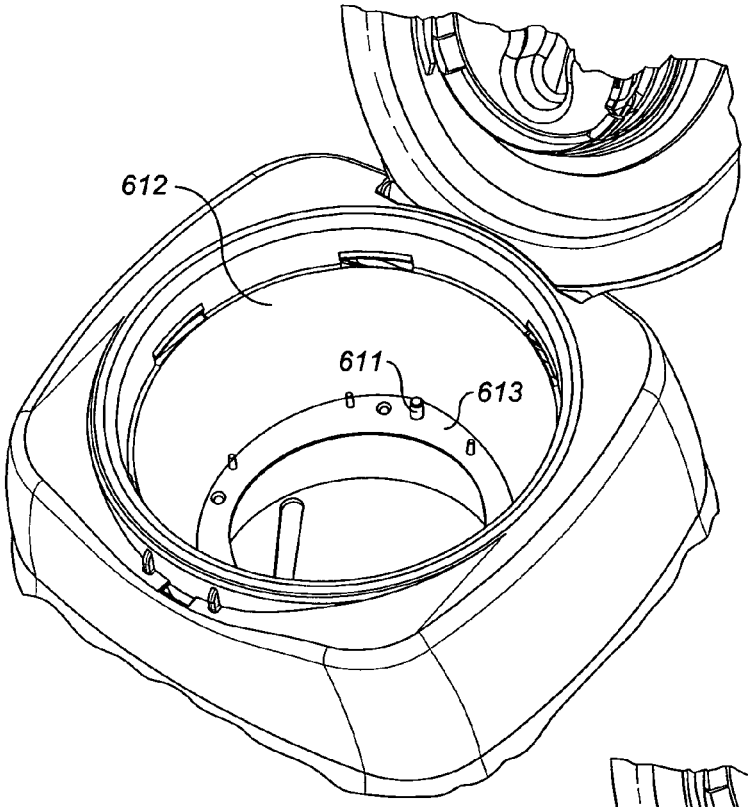
FIG. 19*a* is a perspective view of a detail showing a further aspect of the present invention.
Figure 19B:
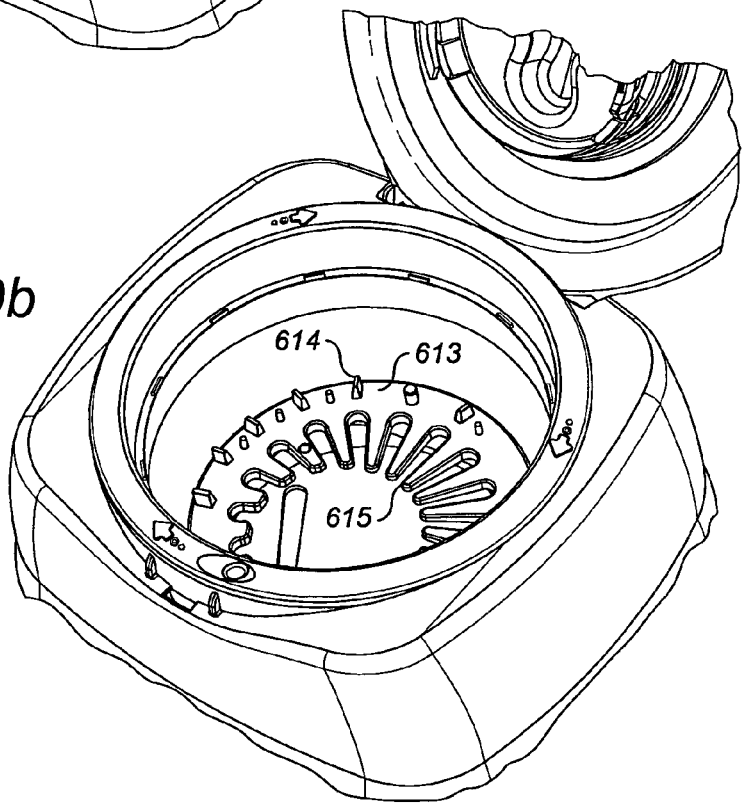
FIG. 19*b* is a further perspective view corresponding to FIG. 19*a* with a diaphragm in place.

In particular one or more pins 611 or ribs 614 protrude upwards from the base surface 613 within the cavity 612 designed to receive the cassette of film tubing. The pins or ribs can locate and guide the cassette as it is rotated. The pins can define an outer or inner circumferential path for the inner or outer wall of the annular cassette base. Alternatively the pins or ribs can define a circumferential path intermediate the inner and outer walls of the cassette. In this case the pins or ribs can locate into an annular groove or grooves in the base of the cassette path and guide the cassette that as it rotates. As shown in FIG. 19*b*, the base surface can be formed by a diaphragm 615 comprising a gripping device of the type shown in FIG. 16 to hold the waste package within the film tubing against rotation to enable a sealing twist to be formed.

As a result of this arrangement, when a cassette is rotated manually to twist the film, noncircular movement of the cassette is minimised. Such movement during rotation can otherwise make it difficult for the user to rotate the cassette as manufacturing tolerances and the requirement for draft angles in the walls to allow removal from an injection mould mean that there is a space for noncircular movement.

Hence rotation of the cassette within the cavity is controlled to minimise unnecessary noncircular movement such as wobbling movement, and rotation of the cassette is made easier.

Figure 20:
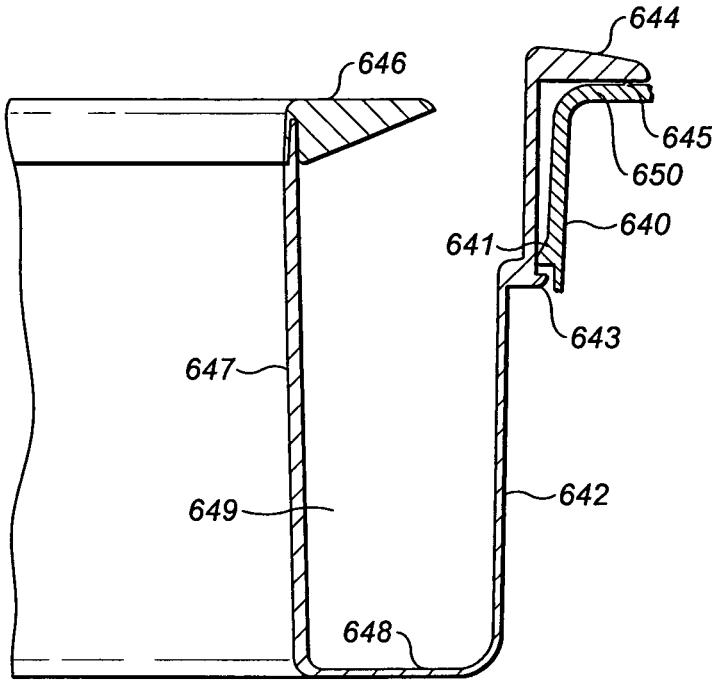
FIG. 20 is a section view of a cassette according to a further aspect of the invention.

According to a further aspect shown in FIG. 20 a waste storage device includes a fixed portion of the housing 640 defining a waste storage cassette receiving chamber in which a cassette 648 is received. The cassette includes a mounting portion spaced from its lower end, for example at the top 644, which is mounted on the fixed portion allowing rotation of the cassette.

The cassette 648 includes, as described above, an outer wall 642, an inner wall 647 and a base defining a tubular film storage cavity 649. A flange 646 is fixed to the top of the inner wall 647 and extends outwardly over the cavity 649 to retain the film inside cassette as described above. Also described above, alternatively the flange may be fixed to the top of the outer wall 642 and extend inwardly over the cavity. The top section of the outer wall of the cassette is configured to sit on the fixed portion such as the main tub body 640 to enable the cassette to rotate within the tub again as described above. In particular an outer flange 644 of generally annular shape extends outwardly from the top rim of the cassette outer wall 642 and seats on a top surface 650 of the fixed portion 640. This fixed portion surface 650 may be simply an inwardly projecting annular support surface and may additionally carry a downwardly depending wall as described in more detail below. In a preferred embodiment the top surface 650 has an annular ring or rib protecting upwardly from its upper face on which the flange 644 rests to minimise contact between the cassette and the tub and hence provide relatively free rotation.

Where the fixed portion includes a downwardly dependent cylindrical portion from the inner edge of the top surface 650, this can include an inwardly extending annular rib 641 having an angled upper face terminating at a horizontal downwardly facing shoulder. The cassette 648 includes a cooperating formation in the form of an annular rib 643 which extends outwardly from outer wall 642 of the cassette. The annular rib 643 includes an angled or curved lower face defining a shoulder having an upwardly facing horizontal portion.

In operation the cassette is pushed into the housing and the inwardly facing annular rib 643 on the outer wall 643 of the cassette passes over and is restrained by the inwardly extending annular rib 641 on the fixed portion 640 of the tub body. As can be seen the two ribs are shaped to allow the slide past each other when the cassette is installed but prevent the cassette being easily removed from the tub in the other direction by abutment of the horizontal faces.

As a result of the arrangement described arrangements of the type shown above in FIG. 5 in which a rotating ring are required can be dispensed with. In such known arrangements there are two parts to supply, namely the cassette itself and the rotating ring upon which it is mounted. In addition with such an arrangement there is a risk that the rotating ring supplied with the tub is discarded together with the cassette in which case replacement parts are required. According to the arrangements described with reference to FIG. 20, there are fewer parts such that manufacturing and assembly is less complex, and less material is required in manufacture of the tub. Furthermore, there is no risk of accidental disposal of the rotating ring as it is formed integrally with the cassette.

Figure 21A:
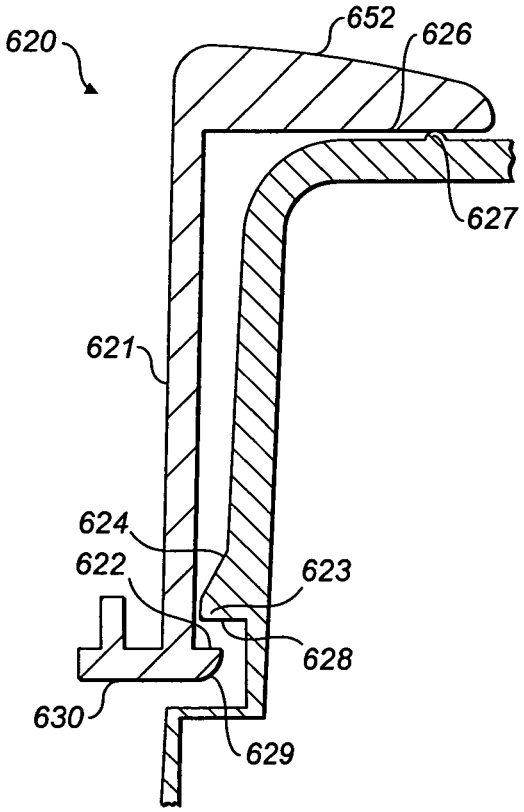
FIG. 21*a* is a section view of a rotating ring according to a known approach.
Figure 21B:
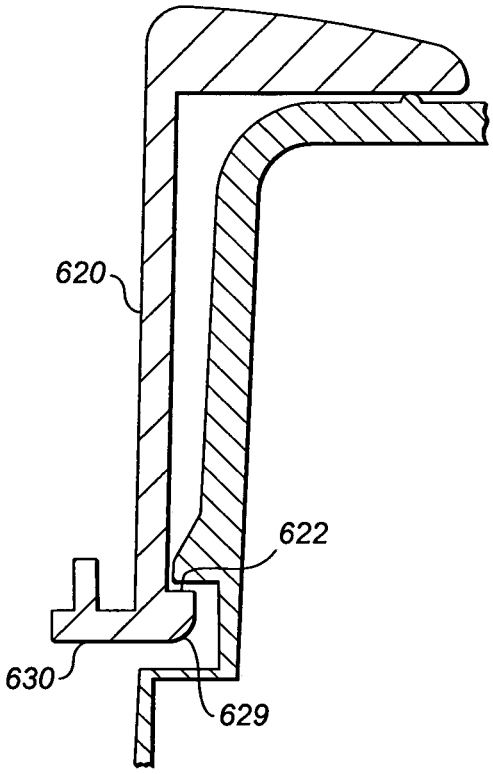
FIG. 21*b* is a section view of an improved rotating ring according to the present invention.
Figure 21C:
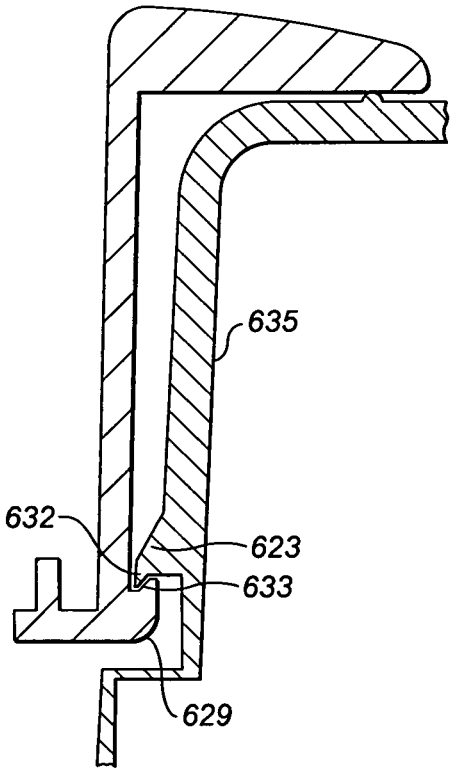
FIG. 21*c* is section view of an alternative improved rotating ring according to the present invention.
Figure 22A:
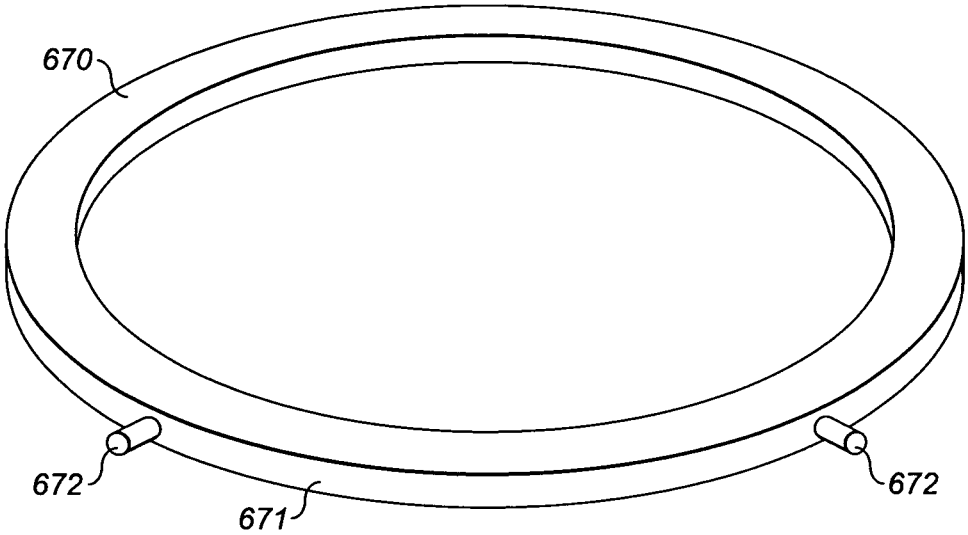
FIG. 22*a* is a perspective view of a flange according to an aspect of the present invention.
Figure 22B:
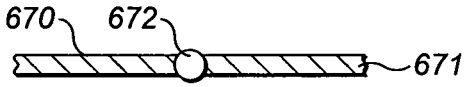
FIG. 22*b* is a side view of the flange of FIG. 22*a;*
Figure 22C:
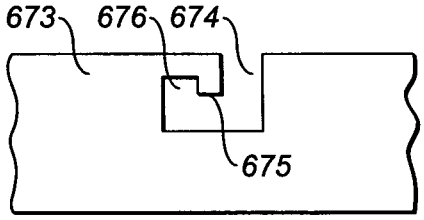
FIG. 22*c* is a schematic view of a receiving slot for the flange of FIGS. 22*a* and 22*b;*
Figure 22D:
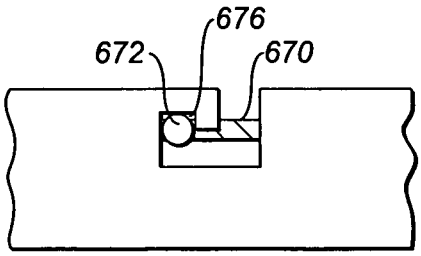
FIG. 22*d* is a schematic view showing the flange received in the slot of FIG. 22*c;*

Referring to FIG. 21*a* to FIG. 21*c*, further aspects of the invention can be understood. In a manner similar to FIG. 11, the waste cassette storing chamber generally 635 comprises a fixed portion which a rotatable portion or rotating ring 620 is rotatably mounted. A cassette can then be supported on the rotating ring 620 on an internally projecting cassette mounting wall or base flange 630.

According to a known arrangement shown in FIG. 21*a* the rotating ring 620 comprises a vertical annular wall 621 with an upper flange 625 at the top resting on a fixed portion and a base flange 630 at the bottom projecting inwardly but including an outwardly extending external rib 629 with a flat upper surface 622 effectively forming a continuation of the base flange 630 and of the same depth. The rotating ring is installed in a waste storage tub 635 so that the cassette can be held by the rotating ring resting on the inner edge of the base flange 630. The rotating ring is installed by pushing it downwards such that the external rib 629 slides over an internal rib 623 of the tub wall 635. The inwardly extending rib 623 has an angled lower surface which deflects passed the external rib as it passes over it to act as detent. The inwardly extending rib 623 has a flat lower surface 628 which limits the upward movement of the rotating ring. Rotation of the rotating ring 620 is improved by provision of a narrow circumferential ring 627 the upper surface of the tub wall 635 on which the flange 625 of the rotating ring 620 rests.

According to the known arrangement shown in FIG. 21*a*, because the rotating ring is made from plastic materials, typically it is easy for the user to remove the rotating ring by pulling it upwards so that the external rib 629 deforms and passes over the inner external rib 623 of the tub body. The user can then accidentally or mistakenly remove and dispose of the rotating ring which requires replacement.

According to a first improved aspect shown in FIG. 21*b* accidental removal of the ring is prevented by ensuring that the external rib 629 on the rotating ring 620 is of sufficient dimension in the direction of sliding to prevent deformation thereof upon application of a detachment force. In particular the flat surface of the external rib is raised to strengthen it such that the deformation is more difficult. For example it can be ensured that the depth of the external rib 622 is greater than that of the flange 630 of the rotating ring.

According to another aspect which can be provided independently of or in conjunction with the arrangement shown in FIG. 21*b*, in FIG. 21*c* the external rib 629 has an upwardly projecting nose portion 633 whilst the internal rib 623 on the tub wall 635 has a downwardly projecting nose portion 632 which is provided radially inward of projected nose portion 633. For example the projecting portions comprise annular projection on the respective parts which provide cooperating formations when viewed in cross section to provide detachment resistance. Changing the flat surfaces 622 and 628 of each of the internal and external ribs to provide complementary detent surfaces 632 and 633 increases the resistance to deformation of the external rib 629. The vertical face of the nose portion 632 is angled upwardly and outwardly and facing nose portion 633 is angled complementarily radially inwardly and downwardly in the preferred embodiment thus acting, upon application of a detachment force, to push the external rib 629 of the rotating ring outwards so that any upward movement of the rotating ring will act to hook the rotating ring to the tub body yet more firmly and prevent the rotating ring from becoming detached.

Referring to FIG. 22*a* to FIG. 22*d* a flange forming the top wall for a cassette for example of the type shown in FIG. 9 can be further understood. As described above, the cassette can include a base portion for example of annular shape together with at least one of an inner and outer cylindrical wall extending upwardly therefrom forming sidewalls for containment of tubing. The top portion of flange 670 includes pegs 672 which form a bayonet fitting with corresponding recesses in one of the inner and outer wall. As described above, the flange 670 generally opposes the base portion and extends at least partially across the top of the cassette to contain tubing whilst allowing passage of the tubing through the remaining gap.

In particular the flange 670 in one embodiment has pins or pegs 672 protruding from its outer edge 671 preferably at regular intervals. For example 3 or 4 or more pins can be provided. The pins allow the flange to fit to the outer wall 673 of a cassette by locating it in a bayonet-type fitting slot 674 in the outer wall. The slot 674 is generally J shaped, extending vertically downwards, then circumferentially with an upwardly extending end section such that the slot is effectively narrowed in its centre by a protruding section 675. There can of course be multiple pending slots configured as appropriate to improve attachment of the flange to the cassette outer wall at several positions simultaneously.

The flange is installed by lowering it down so that all pins 672 pass down the slot 674. The flange or cassette is then rotated slightly so that the pin passes the narrow section provided by the protruding section 675. The flange is then lifted so that it is retained at the end 676 of the slot abutting the narrowed portion 675 to prevent removal. The lifting action can be performed for example by releasing the flange and allowing the compressed film within the cassette body to press the flange upwards.

It will be appreciated, of course, that the pins 672 can instead project from an inner face of the flange 670 and be mounted in cooperating J-shaped slots on the inner wall of the cassette.

The direction of the slot around the cassette wall is selected to ensure that rotation of the cassette and twisting force on the film and flange tends to urge the pins into the slot rather than provide a detachment force.

As a result a simpler and more reliable attachment method is provided compared to known techniques which can involve welding or push fitting the flange past detent-type tabs to locate with holes in the wall of the cassette. For example it has been found that welding traps film whilst tabs and holes can similarly trap film and potentially rip it. By providing bayonet fittings, the attachment arrangement is completely external to the film and will not trap the film nor leave any sharp edges exposed to the film which could rip or tear it.

Figure 23A:
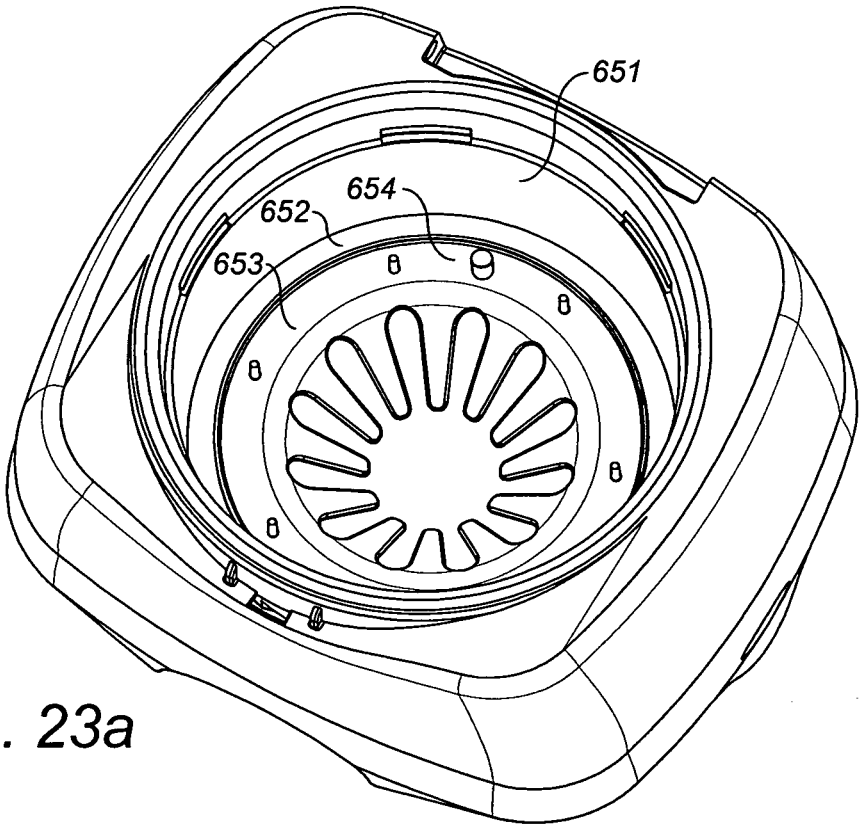
FIG. 23*a* is a perspective view from above of an alternative diaphragm of the present invention.
Figure 23B:
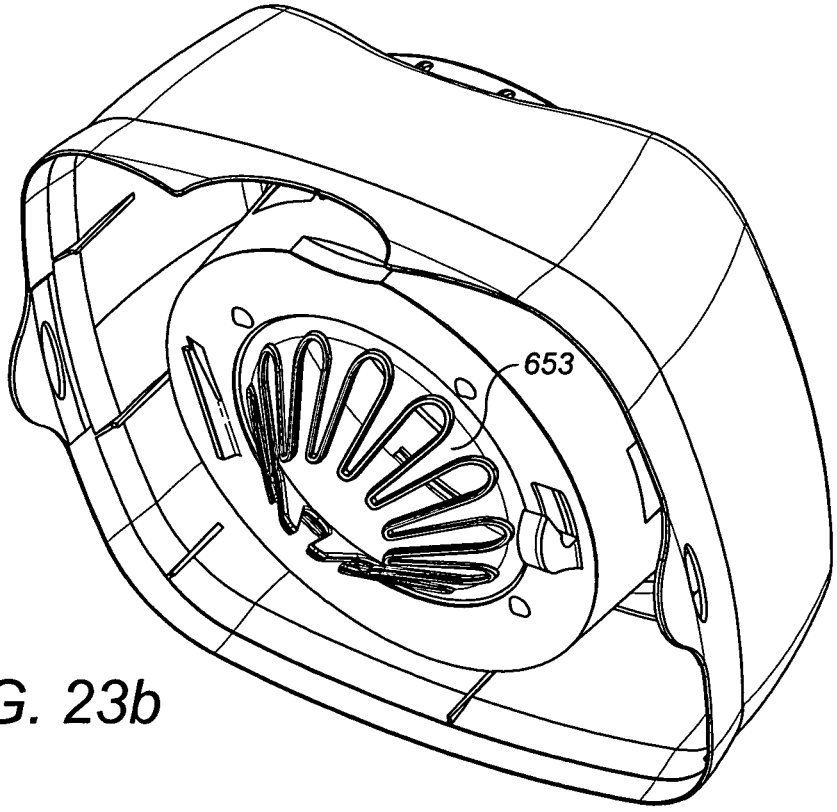
FIG. 23*b* is an underside view of the arrangement of FIG. 23*a;*
Figure 23C:
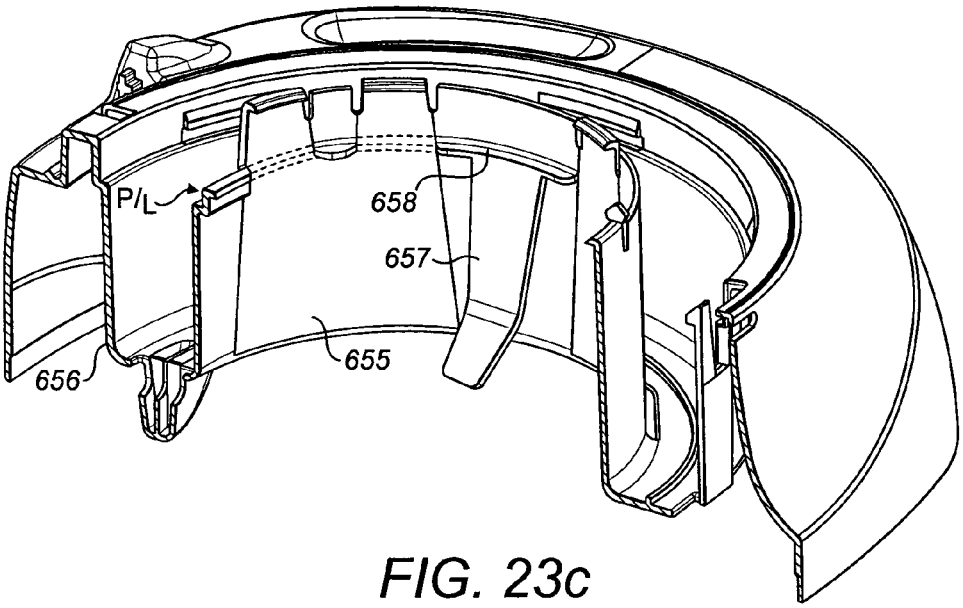
FIG. 23*c* is a cut away view of an alternative arrangement.

Referring to FIG. 23*a* to FIG. 23*c* alternative diaphragm arrangements are described compared to those discussed above with reference, for example, to FIGS. 16 and 17. Referring firstly to FIG. 23*a* and FIG. 23*b*, the waste storage cassette receiving chamber or cavity defines an outlet aperture through which tubing enveloping waste can be passed. The aperture includes a tubing engaging mechanism 652 having a plurality of downwardly and inwardly extending fingers which can define for example a generally dome shaped or conical shaped body with a central orifice. The diaphragm 652 can include a non perforated or continuous radially outer portion with the spaced fingers 653 extending inwardly and downwardly therefrom defining gaps therebetween and terminating short of the centre of the diaphragm to leave a generally circular central aperture.

Known methods including multiple diaphragms or springs and the corresponding materials have met with breakage issues from constant flexing forces. Similarly the flat orientation of known arrangements means that the resistance to pushing through has been insufficient such that enveloped waste can be pushed straight through and not held correctly during rotation, which in turn involves inefficient film use in addition to a requirement for multiple diaphragms and the associated manufacturing cost and complexity.

By using inwardly extending radial fingers 653 which are angled downwards, optimum package retention is provided. The fingers 653 can be moulded from flexible materials such as thermoplastic elastomers (TPE) or blends of plastic and TPE materials to combine properties of each material in a desirable way. The material choice together with the downward radial direction enables the fingers 653 to grip any size of package and prevent movement while the film cassette is rotated to impart twist seal as described above. In a further approach the fingers can be part of a membrane or a gripping device which rotates while the film resource remains stationary, also imparting the requisite twist seal.

Figure 23D:
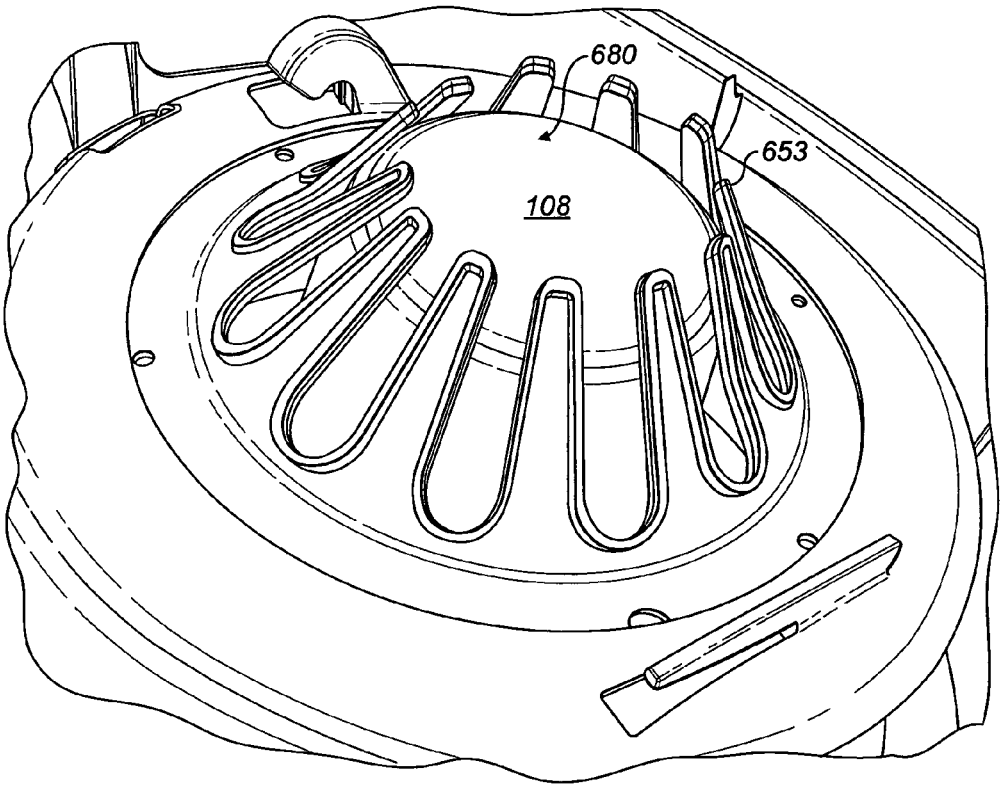
FIG. 23*d* is a view from the underside of the arrangement of FIGS. 23*a* and 23*b* in a closed configuration without a package in place.
Figure 23E:
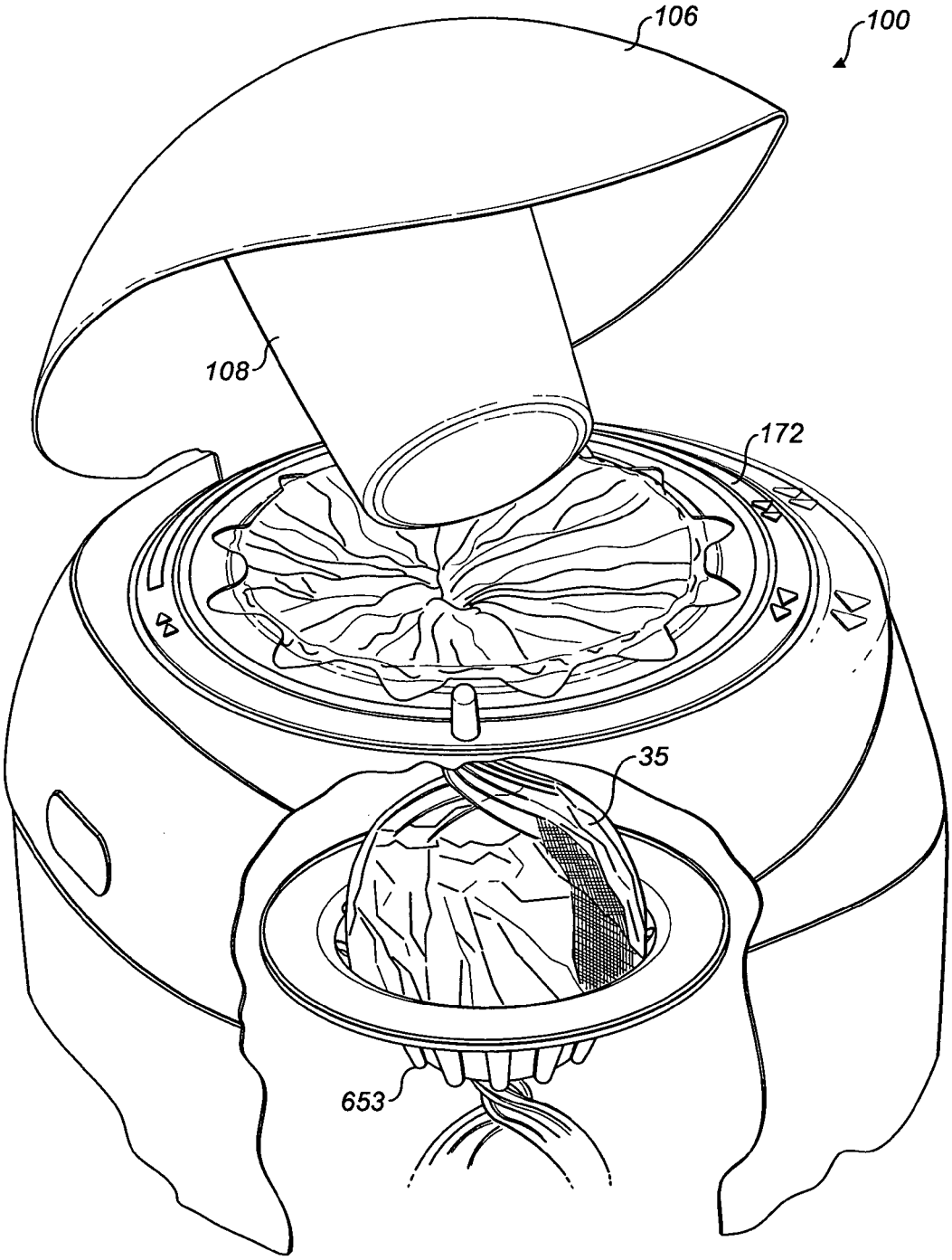
FIG. 23*e* is a perspective view of the arrangement of FIGS. 23*a* and 23*b* in a partially closed configuration with a package in place.

By providing inwardly, downwardly domed fingers of flexible or flexing material, the arrangement provides particular advantages when used in conjunction with the plunger arrangement 108 described above. As can be seen in FIG. 23*d* and FIG. 23*e*, when a package 35 is inserted into the device and held by the fingers 653, closure of the lid 106 brings the plunger into close proximity with the fingers, pushing the package through and into the storage space below. The exterior surface of the plunger and envelope defined by the tapered fingers provide a complementary profile such that the plunger fits with clearance between the upper parts of the fingers but engages, in its closed position with the end portions of the fingers.

The plunger provides means for preparing the waste storage device and cassette for repeated use by creating hollows of flexible tubing for waste items to be placed into. This saves time and effort for the user and also ensures that the user does not use additional flexible tubing unnecessarily.

Operation of the device is hygienic because the user does not have to come into contact with a waste item once it has been placed into the hollow of flexible tubing formed above the waste passage. Specifically, the user does not have to push the waste item or waste package through clamping means or onto the twist of film above the previous waste passage in order to direct it into the waste storage chamber. Instead each waste package is directed into the waste passage by the plunger, which presses on the newly-made twist above a waste package when the lid of the device is replaced after use.

In the arrangement shown the fingers are moulded as a separate diaphragm 652 which is secured to the tub in any appropriate manner for example by being ultrasonically staked onto locating pin 653 or glued. Alternatively the fingers can be moulded as part of the tub assembly. The fingers can be of fully flexible material or can have a rigid support structure such as a plastic skeleton extending into the fingers provide additional strength. The rigid support structure can be a separate diaphragm or part of the tub body with the fingers secured on top, or the fingers and rigid support structure can be co-moulded as a single piece.

The provision of deep, tapered restraining means gives much better control and hence provides more efficient film use and provides less stress on the fingers. The finger material properties can be tuned by blending the flexible TPE and rig if plastic materials as described above. Yet further the fingers 653 ensure that packages of all sizes, for example smaller nappies, are correctly positioned for optimum operation of the device. The tapering fingers allow the diaphragm to engage with waste packages of varying diameter. The narrow, deep, central opening 680 means that small packages are held by the tips of the projecting fingers 653. Because the fingers taper inwardly and downwardly from a relatively larger diameter entry orifice towards the relatively smaller diameter exit orifice or opening, larger packages can be supported by the fingers 653 closer to their outer end and along a large proportion of their length. The design of the fingers, and their flexible nature means that while waste packages are supported before and during the film is twist-sealed above the waste package (thereby preventing the waste package falling into the waste storage chamber and dispensing excess film from the cassette) the fingers can easily be deformed by the downward pressure of the plunger on the newly-formed twist to allow the waste package to pass into the waste storage chamber.

In an alternative arrangement shown in FIG. 23*c*, where the cassette receiving chamber includes an inner wall 655 and an outer wall 656 as discussed with reference to FIGS. 5 to 8, a plurality of selectable fingers 657 for example at least three such fingers can extend downwardly from a upper end of the waste storage cassette receiving chamber from an annular projection 658. In one embodiment the fingers can comprise a generally downwardly projecting portion (for example 5 degrees to the vertical) together with a tip portion and projecting inwardly at a greater angle. Where the fingers are used in conjunction, for example, with the plunger arrangement described above with reference to FIG. 5, the fingers can approximately follow the profile of the plunger.

It will be seen that whether the fingers are provided at the upper or inlet end of the lower or outlet end, the approach is described in either case can be implemented to provide the improvements discussed herein.

Figure 24A:
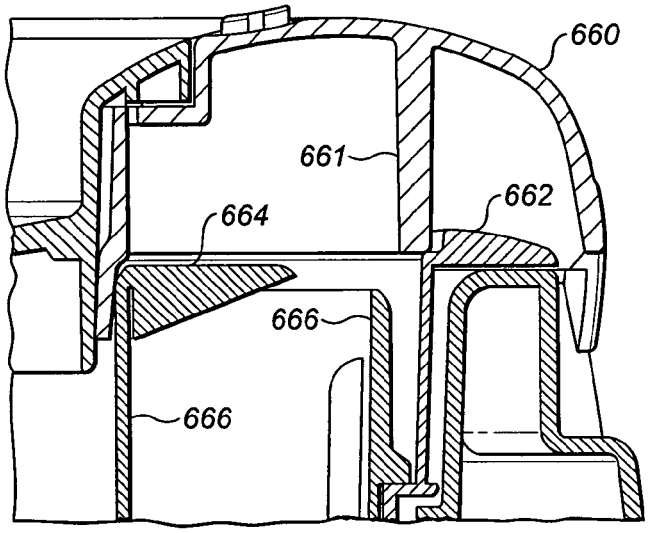
FIG. 24*a* is a sectional view showing a tub lid according to a further aspect of the present invention.
Figure 24B:
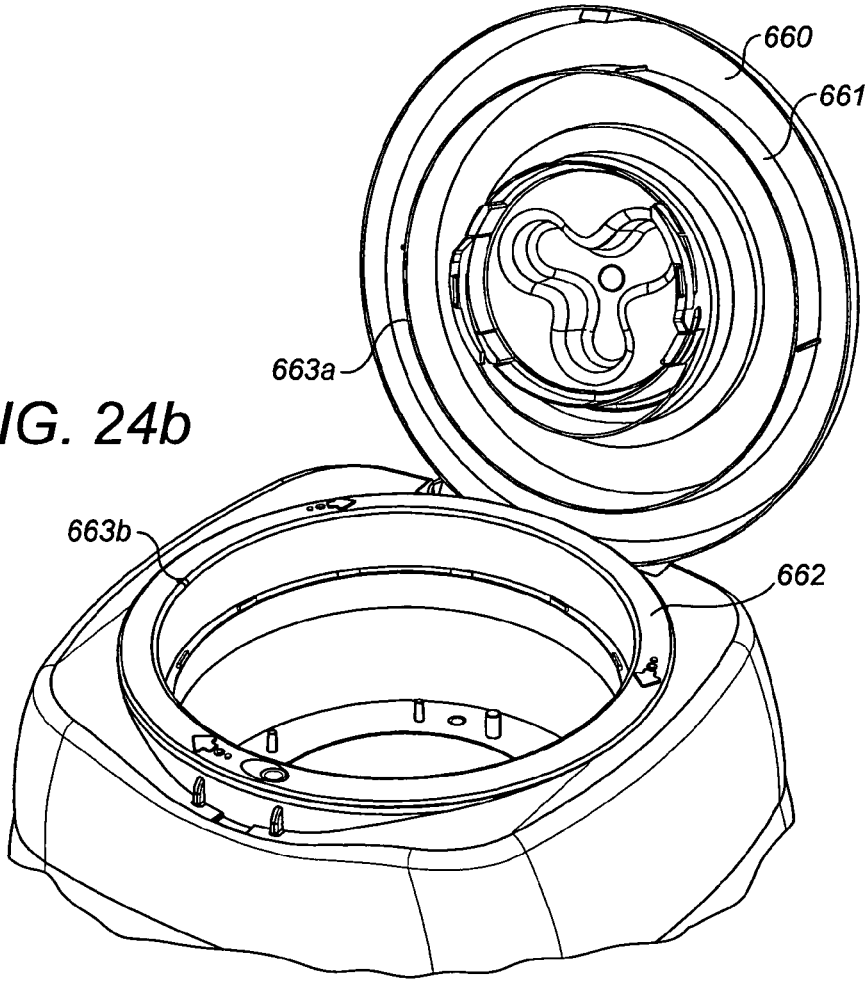
FIG. 24*b* shows the lid of FIG. 24*a* in an open configuration.
Figure 24C:
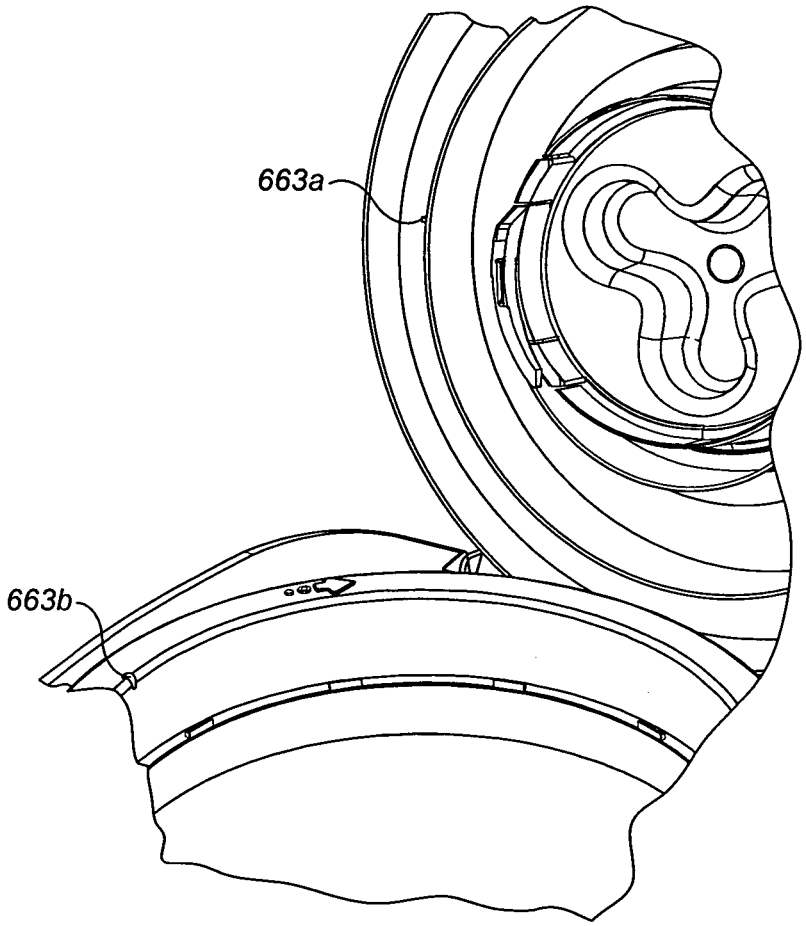
FIG. 24*c* shows in perspective a detail of the lid arrangement of FIG. 24*a*.

FIGS. 24*a* to 24*c* show a lid locking arrangement and an enhancement of the arrangement described above with reference, for example, to FIGS. 11 and 14 and FIG. 5. The waste storage device includes a waste storage cassette receiving chamber which receives a cassette rotatably and includes a rotatable portion or rotating ring rotatably mounted on a fixed portion of the housing as described above. The device further includes a lid 660 which is hinged and closable over the chamber and includes a cutting assembly as discussed, for example, which reference to FIG. 14, for cutting through tubing. The lid 660 and rotating ring 662 have cooperating formations such as ribs or mutually engaging tapering surfaces which engage or abut when the cover is hinged closed to prevent rotation of the rotating ring 662.

In particular the lid is generally circular and includes on its lower face and spaced from its outer cylindrical wall a downwardly projecting (in the closed position) cylindrical wall 661 which depends vertically. In the closed position 661 contacts or abuts the rotating ring 662. In particular the cylindrical wall 661, in an embodiment, includes protruding ribs or projections 663*a* on its distal surface and these arranged to locate with notches or depressions 663*b* in the rotating ring 662 so the that rotating ring cannot move when the lid is down. Of course the position of the ribs and notches can be reversed and any other appropriate abutting or inter engaging formation can be adopted in a similar manner.

According to an alternative arrangement which is not shown, rotation can be prevented by an interference fit between the cylindrical wall 661 and the rotating ring. For example the wall 661 can be tapered slightly inwards and can form an interference fit by wedging inside the cylindrical inner face of the rotating ring which may also be tapered as appropriate. Alternatively again the ribs may be provided on the upper surface of the rotating ring 662 and the distal end of the cylindrical wall 661 forming an interference therebetween.

Although the fit is described as being between the rotating ring and the cylindrical wall, alternatively or additionally the cylindrical wall can be dimensioned to provide interference fit with tapered walls or with ribs and notches abutting inter engagement with the cassette flange, outer wall or inner wall in the same manner as above as appropriate.

In operation the lid is closed and, where the cassette has a "rest position" when a complete twist has been formed, the ribs and notches 663*a*, 663*b* will locate automatically. The interference fit with the wall of the rotating ring or cassette will occur in any position. Then when the cutter is rotated to sever the film there will be no additional rotational movement of the cassette which will render the cutting action more efficient and reduce the requirement to repeat the cutting action to completely sever the film.

Figure 25:
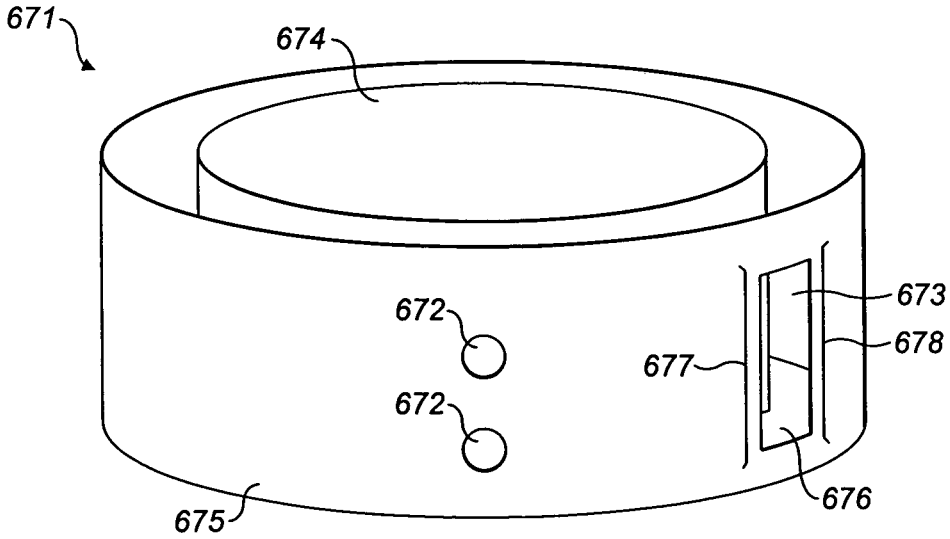
FIG. 25 shows a vented cassette according to a further aspect of the invention.

Refering to FIG. 25 in a further aspect an improved cassette design is provided. The cassette of FIG. 25 corresponds in basic form to that of FIG. 9 or 13 and includes a base portion 676, inner side wall 674 and outer side wall 675 although in practice one or other of the side walls may be omitted. At least one of the base portion side walls is vented. For example the cassette body 671 can have apertures in the form of holes 672 or slots 673 which allow air to vent from the cassette while film is fed into it. Any number and layout of apertures can be placed around the cassette body without complete venting during the filling process and the apertures can be on one or more of the inner side wall, outer side wall or base portion as appropriate.

In the case that elongate slots such as slot 673 are provided these can adversely effect the strength of the walls such that reinforcing ribs 667, 668 comprising thickened portions of the walls can be used to restore the wall's integrity. For example where the slot is elongated in the vertical direction the reinforcing ribs 667, 668 may be elongate and parallel with the slot and provided on either side thereof. Although this involves additional material, far less material is added than has been removed when forming the slot or aperture such that there is an overall material saving which is enhanced by multiple apertures when reinforcing ribs are used around the cassette body.

The arrangement described with reference to FIG. 25 hence allows high speed filling of film into the opening between the inner and outer walls which can otherwise be impeded by trapped air within the pleats of film, slowing down production and potentially damaging the film when the pack of film is compressed prior to fitting the lid or flange into the cassette body. This is because trapped air can act against the compression and cause film to press against the lid or flange as it is fitted thereby causing the film to become trapped between the lid or flange and the cassette body. Yet further by providing multiple cut outs or apertures in the cassette body, material is conserved, significantly reducing the weight and hence material used in creating the cassette.

Fabrication

The various components of the waste storage device and cassette are preferably formed from lightweight plastic or any other suitable material and can be moulded or otherwise formed in any appropriate manner. Preferably the surfaces of the device are wipe-clean.

It will be appreciated that the various embodiments described herein can interchanged or juxtaposed as appropriate. For example any of the cassette embodiments can be used, as appropriate, in any of the tub embodiments and any specific improvements can be implemented on any of the various tub arrangements described or indeed other tub arrangements as appropriate.

The invention claimed is:

1. A waste storage device comprising:

a waste storage cassette chamber having a base surface with a guide formation thereon, the guide formation comprising a projection extending upwardly from the base surface of the chamber; and a waste storage cassette comprising a tubular film and rotatably supported within the chamber, the cassette rotatable within the chamber relative to the guide formation and having a base surface with a guide channel therein, wherein the guide formation is arranged to cooperate with the guide channel to guide the cassette on a rotating path as the cassette is rotated within the chamber relative to the guide formation.

2. A waste storage device as claimed in claim 1 in which the guide formation comprises a plurality of projections, optionally in which at least one projection is provided on a tubing engaging diaphragm arranged at the base surface of the chamber, optionally in which the guide formation is suitable for guiding an outer cassette wall, optionally in which the guide formation is suitable for locating within the guide channel in the cassette base.

3. A waste storage cassette for a waste storage device according to claim 2, the waste storage cassette including a base portion and at least one of an inner and outer side wall extending therefrom, the base portion including a guide channel for receiving a guide formation on a waste storage device suitable for guiding rotation of the cassette therein.

4. A waste storage cassette as claimed in claim 3 in which the cassette further includes an outer wall extending from the base and in which the mounting portion comprises an outwardly extending portion from the outer wall, optionally in which the mounting portion is provided at an opposed end to the base of the cassette, optionally in which the mounting portion comprises an outwardly extending flange, optionally in which the cassette has an outer wall having a detent portion extending therefrom arranged to cooperated with a detent portion on an inner surface of the fixed portion to retain the cassette against detachment from the device.

5. A waste storage cassette for a waste storage device as claimed in claim 3 further comprising:

a top wall opposed to said base portion, in which the top wall is mounted to a sidewall by a bayonet fitting.

6. A waste storage device as claimed in claim 1 further including a lid closable over the chamber and having a cutting assembly for cutting tubing, in which the lid and waste storage cassette have cooperating formations which abut in a closed position of the lid suitable to prevent rotation of the waste storage cassette.

7. A waste storage cassette for a waste storage device according to claim 1, the waste storage cassette including a base portion and at least one of an inner and outer side wall extending therefrom, the base portion including the guide channel for receiving the guide formation on a waste storage device suitable for guiding rotation of the cassette therein.

8. A waste storage cassette for a waste storage device as claimed in claim 7 further including a mounting portion spaced from the base for mounting on a rotatably fixed portion of a waste storage device suitable to allow rotation of a cassette on the fixed portion.

9. A waste storage cassette as claimed in claim 7 in which the cassette further includes an outer wall extending from the base and in which the mounting portion comprises an outwardly extending portion from the outer wall, optionally in which the mounting portion is provided at an opposed end to the base of the cassette, optionally in which the mounting portion comprises an outwardly extending flange, optionally in which the cassette has an outer wall having a detent portion extending therefrom arranged to cooperated with a detent portion on an inner surface of the fixed portion to retain the cassette against detachment from the device.

10. A waste storage cassette for a waste storage device as claimed in claim 7 further comprising:

a top wall opposed to said base portion, in which the top wall is mounted to a sidewall by a bayonet fitting.

11. A waste storage cassette as claimed in claim 10 in which the top wall extends partially across the base portion, optionally in which the waste storage cassette is suitably configured to be rotated in a first direction and the bayonet fitting comprises a twist fitting configured to lock further upon rotation in the first direction.

12. A waste storage cassette for a waste storage device as claimed in claim 7 in which at least one of the base portion and sidewalls is vented.

13. A waste storage cassette as claimed in claim 12 in which a vent comprises at least one of a hole or slot, optionally further including a reinforcement portion adjacent to the vent, preferably in which the reinforcement portion comprises a rib.

14. A waste storage device comprising:

a waste storage cassette chamber having a base surface to receive a cassette comprising a tubular film rotatable thereon, the base surface having a guide formation comprising an upward projection thereon which is arranged to engage with a guide channel in a base of the cassette such that, upon rotation of the cassette relative to the guide formation guides rotation of the cassette along a circumferential path.

* * * * *